US010849819B2

(12) United States Patent
Le et al.

(10) Patent No.: US 10,849,819 B2
(45) Date of Patent: Dec. 1, 2020

(54) SYSTEM AND METHOD FOR BODY STRETCHING BY MASSAGE CHAIR

(71) Applicant: LURACO, INC., Arlington, TX (US)

(72) Inventors: Kevin Le, Richland Hills, TX (US); Thanh Le, Arlington, TX (US); Varad Gokhale, Irving, TX (US)

( * ) Notice: Subject to any disclaimer, the term of this patent is extended or adjusted under 35 U.S.C. 154(b) by 89 days.

(21) Appl. No.: 16/290,748

(22) Filed: Mar. 1, 2019

(65) Prior Publication Data

US 2019/0192379 A1 Jun. 27, 2019

Related U.S. Application Data

(63) Continuation-in-part of application No. 14/103,840, filed on Dec. 11, 2013.

(51) Int. Cl.

| | |
|---|---|
| ***A61H 23/00*** | (2006.01) |
| ***A61H 23/04*** | (2006.01) |
| ***A61H 15/00*** | (2006.01) |

(52) U.S. Cl.

CPC ..... *A61H 23/04* (2013.01); *A61H 15/0078* (2013.01); *A61H 2015/0028* (2013.01);
(Continued)

(58) Field of Classification Search

CPC .... A61H 2203/0431; A61H 2203/0437; A61H 15/00; A61H 15/0078; A61H 23/006; A47C 1/034

See application file for complete search history.

(56) References Cited

U.S. PATENT DOCUMENTS 4,422,448 A 12/1983 Sugai et al.
4,422,449 A 12/1983 Hamabe
(Continued)

FOREIGN PATENT DOCUMENTS

CN 14465259 A 10/2003
CN 100398081 C 7/2008
(Continued)

OTHER PUBLICATIONS

Office Action in related U.S. Appl. No. 14/103,840, dated Apr. 6, 2016, 17 pages.
(Continued)

*Primary Examiner* — Timothy A Stanis
(74) *Attorney, Agent, or Firm* — Law Office of Jeff Williams PLLC; J. Oliver Williams

(57) ABSTRACT

A massage chair includes a frame having a base frame and a backrest frame. The backrest frame pivotally couples to the base frame and operates between at least two positions. The backrest frame has a mechanical rotating joint and guide rail. The guide rail splits at the rotating joint when transitioning positions. An extendable footrest frame is included and pivots relative to the backrest frame. A foot massage airbag system includes a plurality of airbags coupled to the extendable footrest frame. An electronic circuit board has an embedded software program for regulating the position of the backrest frame and the footrest frame. Additionally, the electronic circuit board communicates with a compressor and valve to regulate operation of the airbags. Operation of the airbags induces a stretching effect upon a user as the airbags inflate to compress against the user and the extendable footrest frame extends.

28 Claims, 20 Drawing Sheets

(52) U.S. Cl.
CPC ..... *A61H 2201/0103* (2013.01); *A61H 2201/0149* (2013.01); *A61H 2201/1223* (2013.01); *A61H 2201/149* (2013.01); *A61H 2201/1666* (2013.01); *A61H 2201/5002* (2013.01); *A61H 2201/5007* (2013.01); *A61H 2201/5056* (2013.01); *A61H 2201/5058* (2013.01); *A61H 2205/081* (2013.01); *A61H 2205/108* (2013.01)

(56) References Cited

U.S. PATENT DOCUMENTS

| | | | | |
|---|---|---|---|---|
| 4,574,786 | A | 3/1986 | Hashimoto et al. | |
| 5,020,518 | A | 6/1991 | Spears et al. | |
| 5,233,973 | A | 8/1993 | Gill et al. | |
| 5,304,112 | A | 4/1994 | Mrklas et al. | |
| 5,439,437 | A * | 8/1995 | Lyons | A61H 15/00 601/115 |
| 5,769,799 | A | 6/1998 | Daughtry | |
| 6,000,758 | A * | 12/1999 | Schaffner | A47C 1/0345 297/180.12 |
| 6,224,563 | B1 | 5/2001 | Nonoue et al. | |
| 6,315,744 | B1 * | 11/2001 | Inaba | A61H 9/0078 601/148 |
| 6,394,970 | B1 | 5/2002 | Maier | |
| 6,511,448 | B1 | 1/2003 | Furuie et al. | |
| 6,629,939 | B2 | 10/2003 | Jikiba et al. | |
| 6,656,140 | B2 | 12/2003 | Oguma et al. | |
| 6,749,577 | B2 | 6/2004 | Kume et al. | |
| 6,991,609 | B2 | 1/2006 | Kan et al. | |
| 7,806,840 | B2 | 10/2010 | Chen | |
| 7,854,710 | B2 | 12/2010 | Liang | |
| 7,947,002 | B2 | 5/2011 | Mizoguchi et al. | |
| 2002/0193713 | A1 | 12/2002 | Lee | |
| 2004/0122343 | A1 | 6/2004 | Mori et al. | |
| 2005/0010144 | A1 | 1/2005 | Chen | |
| 2005/0090769 | A1 | 4/2005 | Chen | |
| 2005/0234371 | A1 * | 10/2005 | Kurata | A61H 1/0266 601/34 |
| 2005/0288612 | A1 * | 12/2005 | Suzuki | A61H 1/0266 601/151 |
| 2006/0111653 | A1 | 5/2006 | Nishio et al. | |
| 2006/0241536 | A1 * | 10/2006 | Yoda | A61H 7/00 601/98 |
| 2007/0239089 | A1 | 10/2007 | Chiu | |
| 2007/0299377 | A1 | 12/2007 | Shiraishi | |
| 2008/0009777 | A1 | 1/2008 | Chiu | |
| 2008/0097260 | A1 | 4/2008 | Tsukada et al. | |
| 2009/0099489 | A1 * | 4/2009 | Tanizawa | A61H 9/0078 601/84 |
| 2009/0100599 | A1 * | 4/2009 | Rawls-Meehan | A47C 20/041 5/616 |
| 2009/0306558 | A1 | 12/2009 | Chen | |
| 2009/0306588 | A1 | 12/2009 | Nguyen et al. | |
| 2010/0030121 | A1 | 2/2010 | Fu | |
| 2010/0207438 | A1 * | 8/2010 | Inoue | A61H 1/0244 297/284.2 |
| 2012/0215143 | A1 * | 8/2012 | Inada | A61H 1/003 601/112 |
| 2013/0088059 | A1 | 4/2013 | Nagamitsu | |
| 2015/0051526 | A1 * | 2/2015 | Wang | A47C 7/70 601/99 |

FOREIGN PATENT DOCUMENTS

| | | | |
|---|---|---|---|
| CN | 101744707 | B | 10/2011 |
| EP | 1210927 | B1 | 5/2002 |
| EP | 1230904 | A2 | 8/2002 |
| JP | H06209 | A | 1/1994 |
| JP | H1119150 | A | 1/1999 |

OTHER PUBLICATIONS

Office Action in related U.S. Appl. No. 14/103,840, dated May 17, 2017, 35 pages.
Office Action in related U.S. Appl. No. 14/108,840, dated Jun. 13, 2018, 33 pages.
Office Action in related U.S. Appl. No. 14/103,840, dated Dec. 7, 2016, 19 pages.
Office Action in related U.S. Appl. No. 14/103,840, dated Jan. 9, 2018, 46 pages.
Office Action in related U.S. Appl. No. 14/103,840, dated Jan. 7, 2019, 35 pages.
"MassageChairStore.com," downloaded Sep. 12, 2013, <URL:http://www.massagechairstore.com/>.
"How Massage Chairs Work," downloaded Sep. 12, 2013, <URL:http://electronics.howstuffworks.com/gadgets/home/massage-chair1.htm>.
"Osaki OS-4000 Instruction Manual," downloaded Sep. 12, 2013, <URL:http://www.hitechmassagechairs.com/PDF/OS-4000-Manual.pdf>.
"Luminous-spa-pedicure-chair-owner-manual," downloaded Aug. 15, 2016, <URL:http://uspedicurespa.com/resources/lexor/luminous-spa-pedicure-chair-owner-manual.pdf >.
Office Action in related U.S. Appl. No. 14/103,840, dated Apr. 30, 2019, 36 pages.

* cited by examiner

SYSTEM AND METHOD FOR BODY STRETCHING BY MASSAGE CHAIR

CLAIM OF PRIORITY

This application claims the benefit of and is a Continuation-In-Part of U.S. patent application Ser. No. 14/103,840, filed 11 Dec. 2013. The information contained therein is hereby incorporated by reference.

BACKGROUND

1. Field of the Invention

The present invention generally relates to massage chairs and massage devices and apparatuses for massage chairs. More specifically, the present invention is directed to a massage chair that provides massage benefits and a stretching effect upon a user through the selective use of a plurality of airbags and frame positioning.

2. Description of Related Art

Massage chairs and massage devices and apparatuses for massage chairs are known in the art.

Most or all of the patents, published patent applications, and/or nonpatent publications directed at massage chairs and massage devices and apparatuses for massage chairs disclose massage benefits or effects being provided to a back body area of a user. At least one discloses massage benefits or effects being provided from the neck to the shoulder, back, and hips.

The present invention overcomes one or more of the shortcomings of the above described massage chairs and massage devices and apparatuses for massage chairs. The Applicant is unaware of inventions or patents, taken either singly or in combination, which are seen to describe the present invention as claimed.

Although strides have been made to massage chairs, shortcomings remain.

SUMMARY OF THE INVENTION

The present invention is directed to a massage chair including a frame having a base frame and a backrest frame. The backrest frame pivotally couples to the base frame and operates between at least two positions. The backrest frame has a mechanical rotating joint and guide rail. The guide rail splits at the rotating joint when transitioning positions. An extendable footrest frame is included and pivots relative to the backrest frame. A foot massage airbag system includes a plurality of airbags coupled to the extendable footrest frame. An electronic circuit board has an embedded software program for regulating the position of the backrest frame and the footrest frame. Additionally, the electronic circuit board communicates with a compressor and valve to regulate operation of the airbags. Operation of the airbags induces a stretching effect upon a user as the airbags inflate to compress against the user and the extendable footrest frame extends.

An object of the present application is to provide the massage chair with a built-in rechargeable battery pack to provide backup power to the electronic circuit board so as to enable a return to an upright position of the massage chair. The electronic circuit board may switch automatically to a low power mode when the upright position is reached.

Another object of the present application is to facilitate selective control of the plurality of airbags such that the airbags may operate simultaneously and/or in an alternating manner.

The airbags may be seen to induce the stretching effect upon one or more portions of a user's body, including the lower and upper appendages and core torso. The airbags may be located on the backrest frame, a seat portion, and the footrest frame.

The backrest frame is independently pivotal relative to the seat portion. The backrest frame includes a back-reclining actuator configured to pivot the backrest frame relative to the seat portion. Guide rails in the backrest frame split at a point between the back portion and the seat portion.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
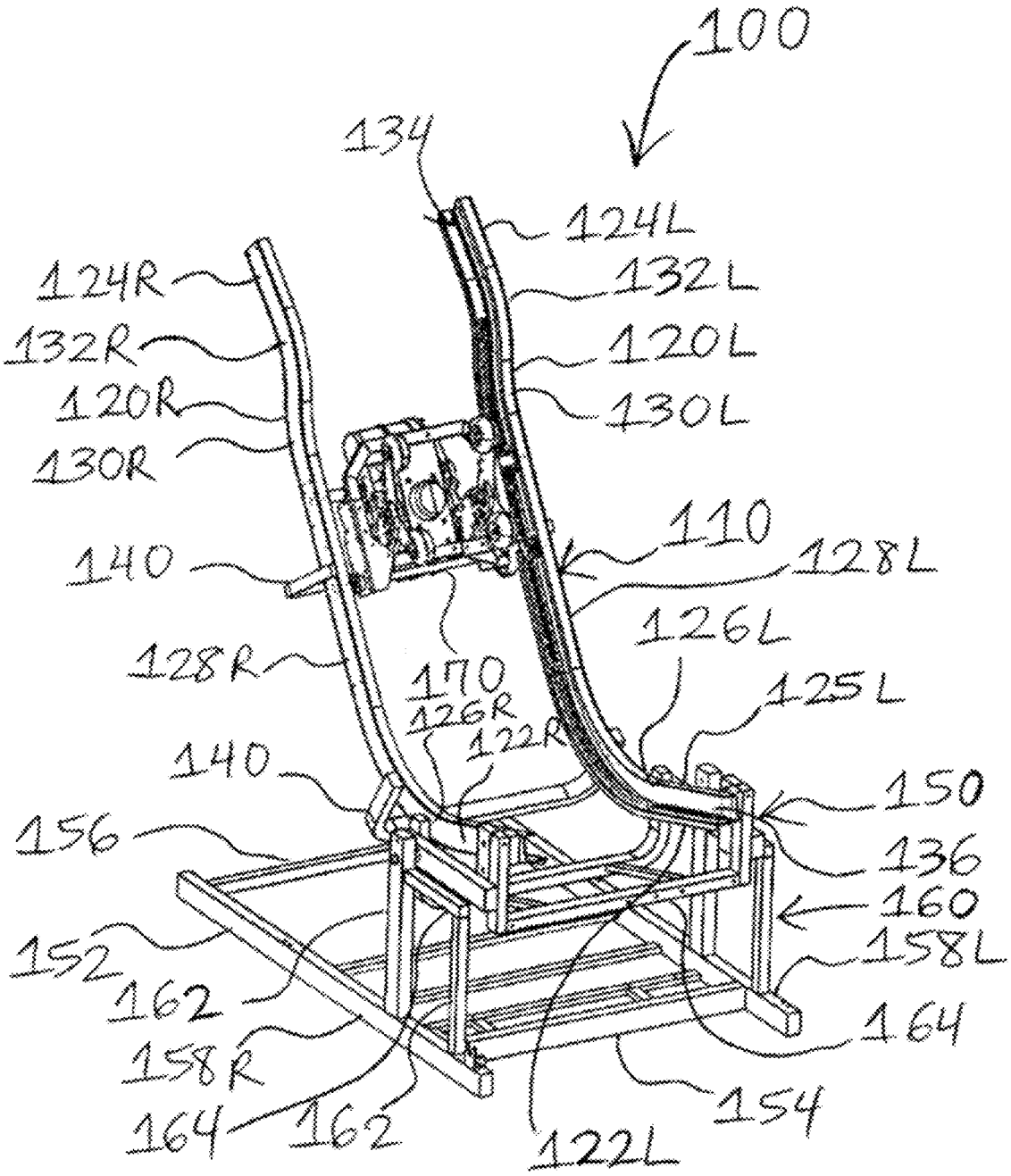
FIG. 1 is a perspective view of a massage apparatus for a massage chair according to the present invention.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Referring to FIGS. 1-8, the present invention is directed to a massage apparatus 100 for a massage chair wherein massage benefits or effects are provided to a back body area, a bottom body area, and a thigh body area of a user (not shown). Massage benefits or effects may also be provided to a head and neck body area of the user. The massage apparatus 100 includes a frame 110 and a massage device 170.

Figure 2:
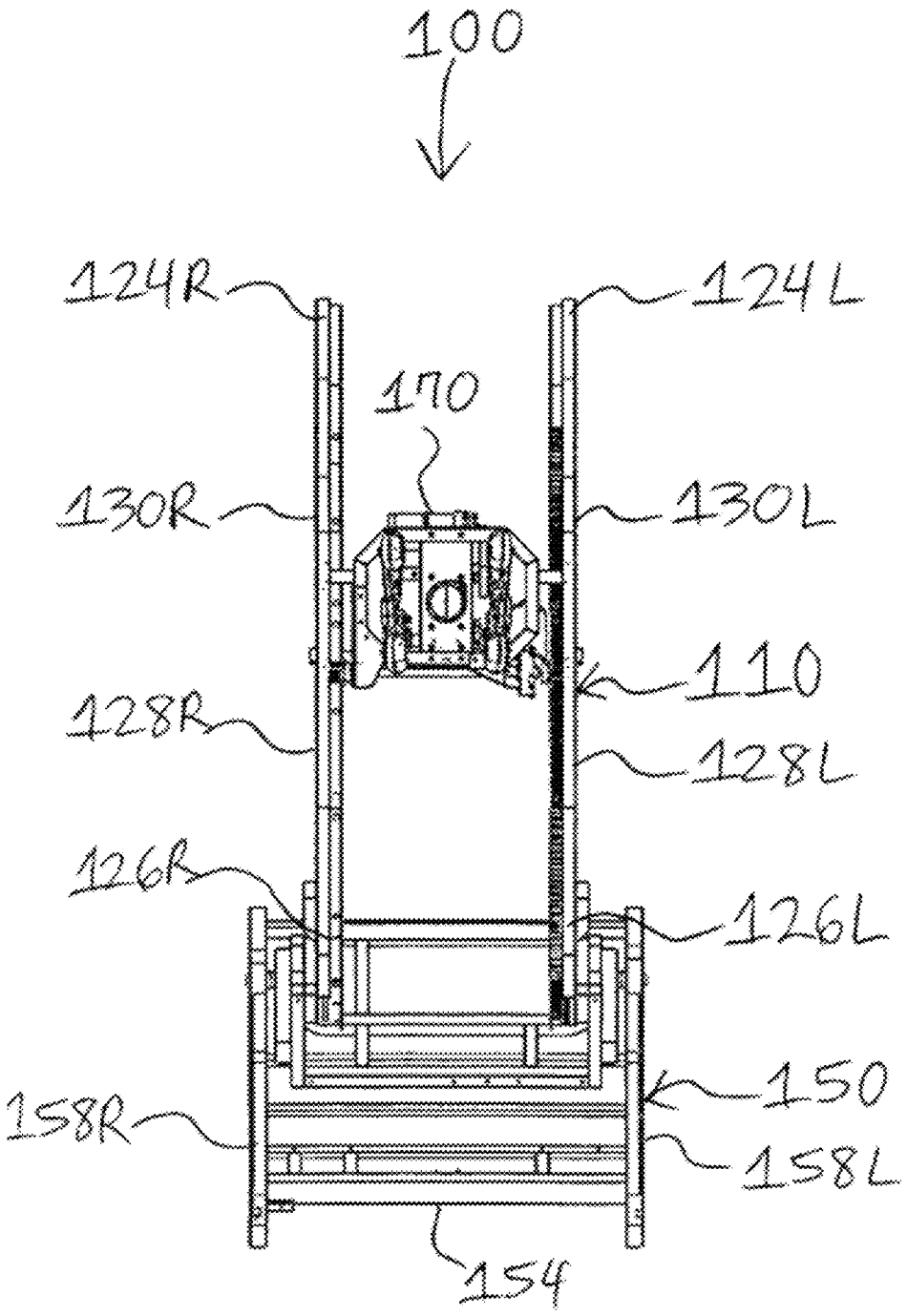
FIG. 2 is a front view of the massage apparatus for a massage chair of FIG. 1.
Figure 3:
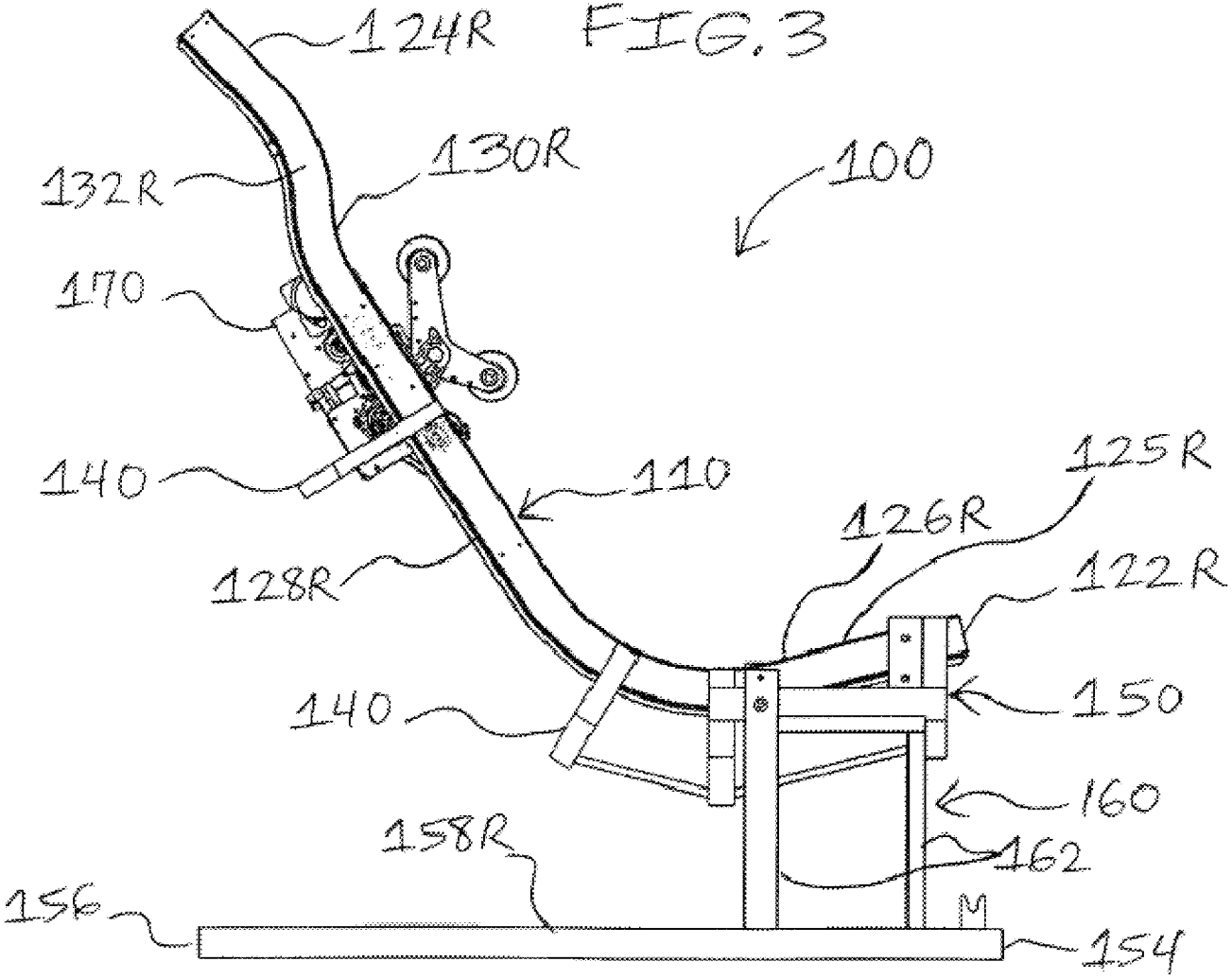
FIG. 3 is a right side view of the massage apparatus for a massage chair of FIG. 1.

As a non-limiting example and as best shown in FIGS. 1-3, the frame 110 includes a pair of opposing guide rails 120R, 120L, a plurality of guide rails stabilizing bars 140, and a base stand 150. The guide rails 120R, 120L are secured to the base stand 150, and are positioned generally above the base stand 150. The base stand 150 supports the weights of the guide rails 120R, 120L, massage device 170, and user (not shown) of the massage chair.

Preferably, the guide rails 120R, 120L are substantially similar or mirror images of one another. Each of the guide rails 120R, 120L includes a first end 122R, 122L, a second end 124R, 124L, a thigh body area portion 125R, 125L located adjacent the first end 122R, 122L, a seat or bottom body area portion 126R, 126L located adjacent the thigh body area portion 125R, 125L and away from the first end 122R, 122L, a back body area portion 128R, 128L extending upward from the bottom body area portion 126R, 126L, a head and neck body area portion 130R, 130L extending upward from the back body area portion 128R, 128L and located about the second end 124R, 124L, an outer side 132R, 132L, an inner side 134, and a guide channel 136 extending from the thigh body area portion 125R, 125L to the back body area portion 128R, 128L, preferably to the head and neck body area portion 130R, 130L, and running along the inner side 134 of the guide rail 120R, 120L. The guide channel 136 includes gear teeth 138 for engaging with at least one gear member from the massage device 170 when the massage device 170 moves upward and downward in a generally vertical direction from the first end 122R, 122L toward the second end 124R, 124L of the guide rail 120R, 120L and vice versa, respectively. Preferably, each of the guide rails 120R, 120L has a generally "L-shaped" configuration. In this configuration, the lower portion of the "L" includes the thigh body area portion 125R, 125L and bottom body area portion 126R, 126L, and the upper portion of the "L" includes the back body area portion 128R, 128L and head and neck body area portion 130R, 130L. As best shown in FIGS. 1 and 3, more preferably, each of the guide rails 120R, 120L has a reclining "L-shaped" configuration.

The plurality of guide rails stabilizing bars 140 help to stabilize the positioning of the guide rails 120R, 120L relative to one another. Each of the guide rails stabilizing bars 140 has a first end 142, a second end 144, and a body portion 146 extending from the first end 142 to the second end 144. Preferably, each of the guide rails stabilizing bars 140 has a generally "U-shaped" configuration. The guide rails stabilizing bars 140 are secured at predetermined locations along the outer sides 132R, 132L of the guide rails 120R, 120L.

The base stand 150 includes a base 152 and a guide rails support structure 160. The base 152 includes a first or front end 154, a second or rear end 156, and a pair of opposing sides 158R, 158L. The guide rails support structure 160 is secured about the front end 154 of the base 152, and is positioned above the base 152. The guide rails support structure 160 includes a plurality of vertical bars or members 162 and a plurality of horizontal bars or members 164. The plurality of vertical bars 162 extend upward from the pair of opposing sides 158R, 158L of the base 152, and, along with the plurality of horizontal bars 164, form a support frame with a "square-shaped" or "rectangular-shaped" box configuration.

Since the base stand 150 supports the weights of the guide rails 120R, 120L, massage device 170, and user of the massage chair, the base stand 150 is preferably made or manufactured of a strong material, such as, but not limited to, steel, metal, wood, hard plastic, any combination of the listed materials, and any material or combination of materials known to one of ordinary skill in the art. Also, the guide rails 120R, 120L may be made or manufactured of steel, metal, wood, plastic, any combination of the listed materials, and any material or combination of materials known to one of ordinary skill in the art.

The massage device 170 includes a power source, at least one massage element, and at least one gear member. The massage device 170 may be a conventional massage device or any applicable massage device that is known to one of ordinary skill in the art.

As a non-limiting example and as best shown in FIGS. 4-8, the massage device 170 includes a pair of massage device moving members 172R, 172L, a pair of gear members 174R, 174L, a pair of massage arms 180R, 180L, a first motor 176, a second motor 178, a third motor 190, a rotation shaft 192 driven by the first motor 176, a pair of rotation to knocking translator members 194, a rotation shaft 195 driven by the second motor 178, a pair of rotation to kneading translator members 196, a rotation shaft 197 for vertical movement gears driving, a speed reduction belt 198 for the first motor 176, and a speed reduction belt 199 for the second motor 178.

Figure 4:
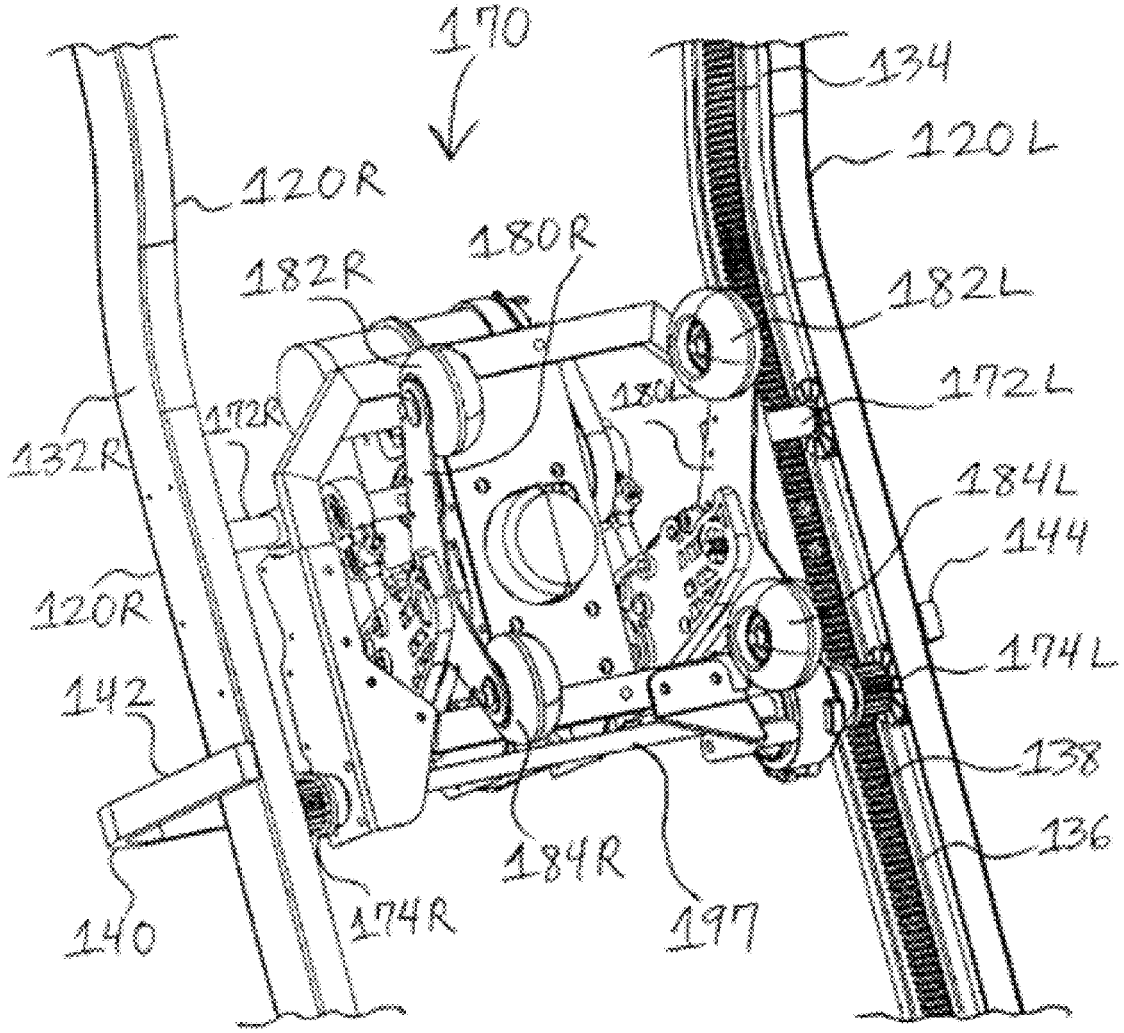
FIG. 4 is a perspective, front view of a massage device of the massage apparatus for a massage chair of FIG. 1.
Figure 5:
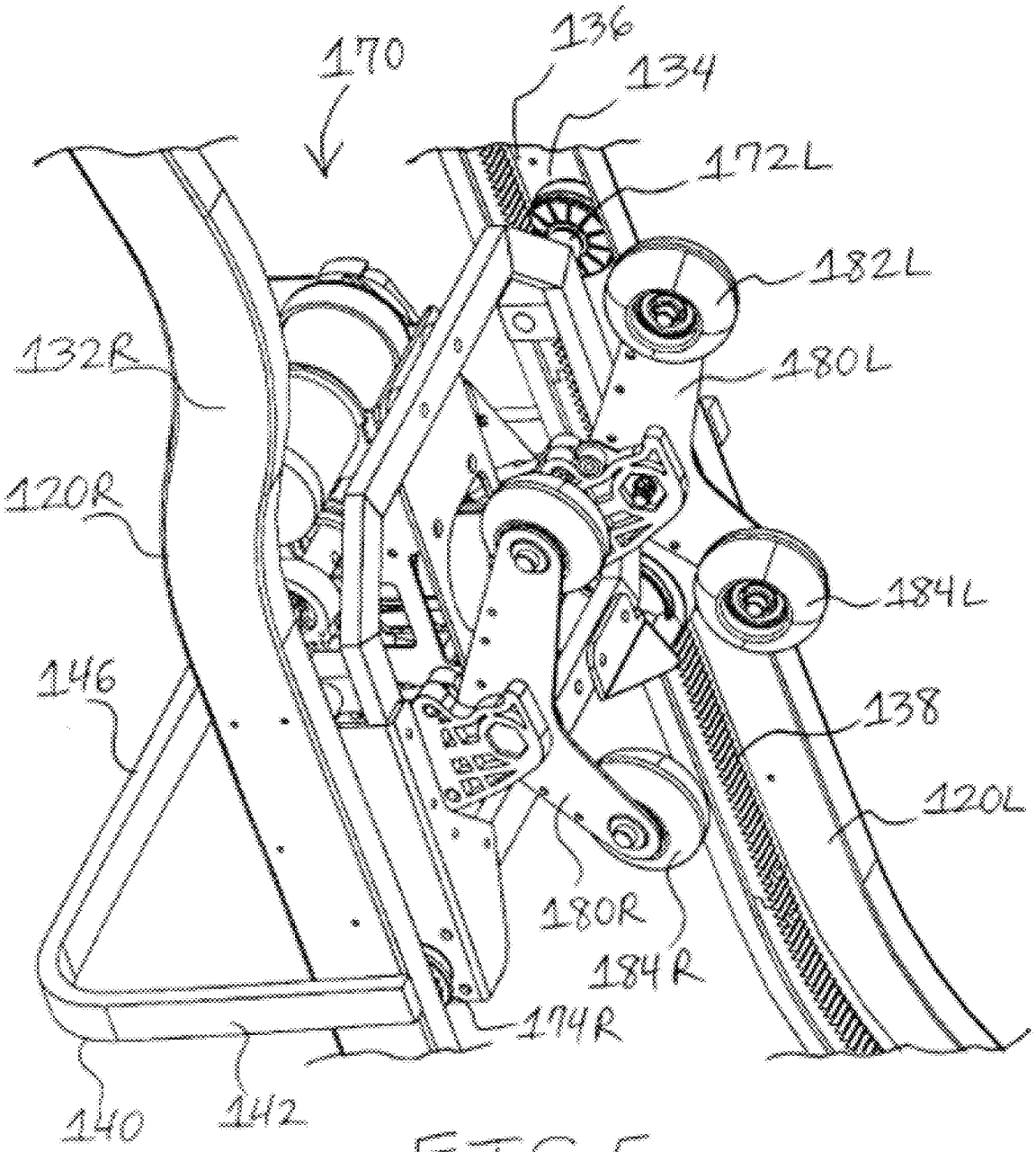
FIG. 5 is a perspective, front and right side view of a massage device of the massage apparatus for a massage chair of FIG. 1.

As best shown in FIGS. 4 and 5, each of the pair of massage device moving members 172R, 172L is positioned within a corresponding guide channel 136 of a guide rail 120R, 120L, and helps the massage device 170 move in a generally vertical direction along the guide channel 136.

As best shown in FIGS. 4 and 5, each of the pair of gear members 174R,174L is positioned within a corresponding guide channel 136 of a guide rail 120R, 120L, and engages with the teeth 138 located in the corresponding guide channel 136.

As best shown in FIGS. 4-8, each of the pair of massage arms 180R, 180L includes a first or upper massage roller 182R, 182L and a second or lower massage roller 184R, 184L. Each of the pair of massage arms 180R, 180L can move vertically. As a non-limiting example, each of the pair of massage arms 180R, 180L may be able to move both vertically and laterally. The massage rollers 182R, 182L, 184R, 184L provide massage benefits or effects to a back body area, a bottom body area, and a thigh body area of the user when the massage device 170 is moved to, near or about that particular body area. The massage rollers 182R, 182L, 184R, 184L may also provide massage benefits or effects to a head and neck area of the user when the massage device 170 is moved to, near or about the head and neck area. It will be understood by one of ordinary skill in the art that the timing of the pattern of the raising and lowering may be varied on each roller 182R, 182L, 184R, 184L, such as by adjusting the degree of rotation of one or more of the following: rotation shaft 192 driven by the first motor 176, pair of rotation to knocking translator members 194, rotation shaft 195 driven by the second motor 178, pair of rotation to kneading translator members 196, speed reduction belt 198 for the first motor 176, and speed reduction belt 199 for the second motor 178. Also, it will be understood by one of ordinary skill in the art that the rate of speed of rotation as well as the direction of rotation of the rollers 182R, 182L, 184R, 184L may be adjusted by varying the motor speed or direction.

Figure 6:
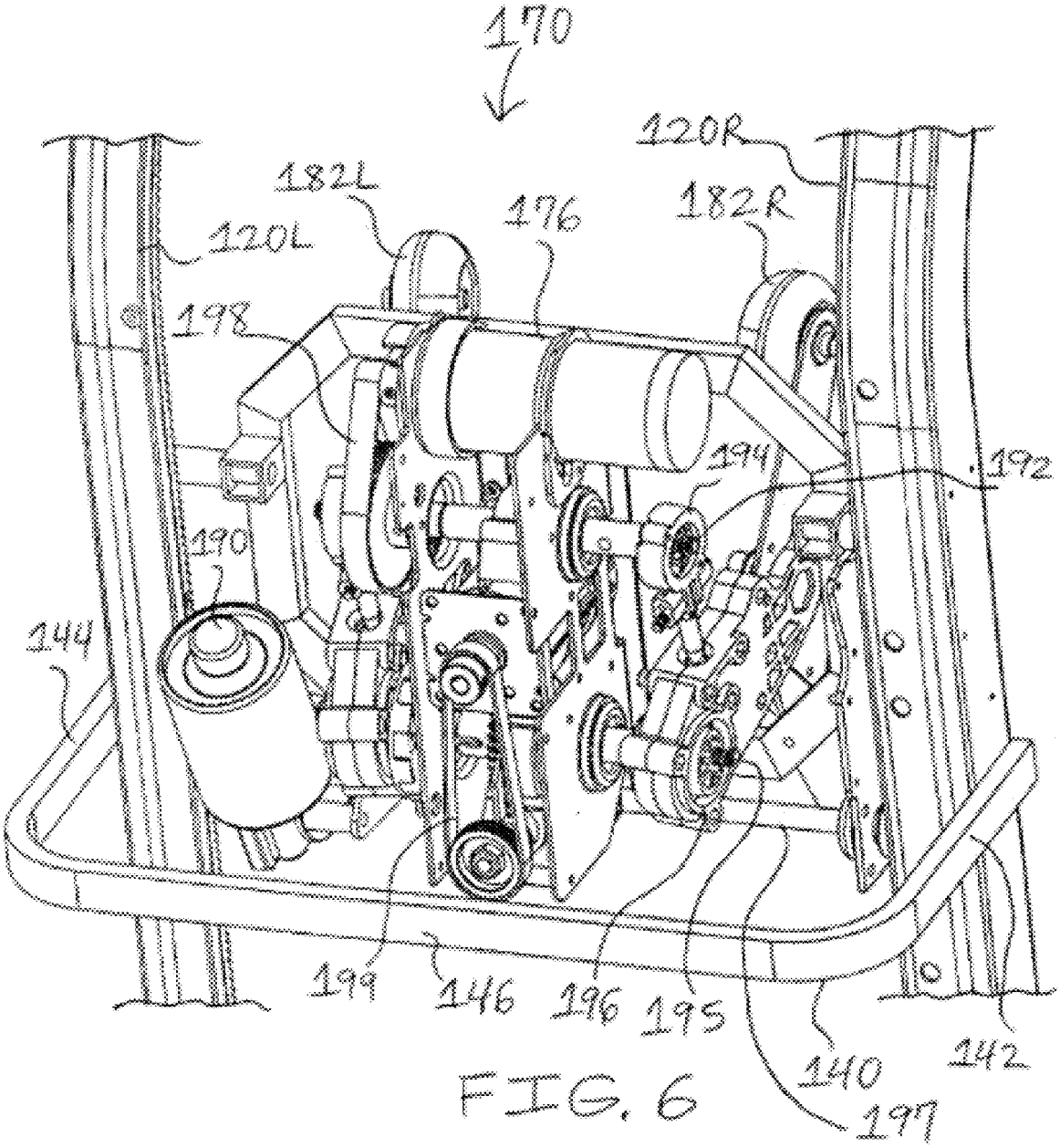
FIG. 6 is a perspective, rear view of a massage device of the massage apparatus for a massage chair of FIG. 1.
Figure 7:
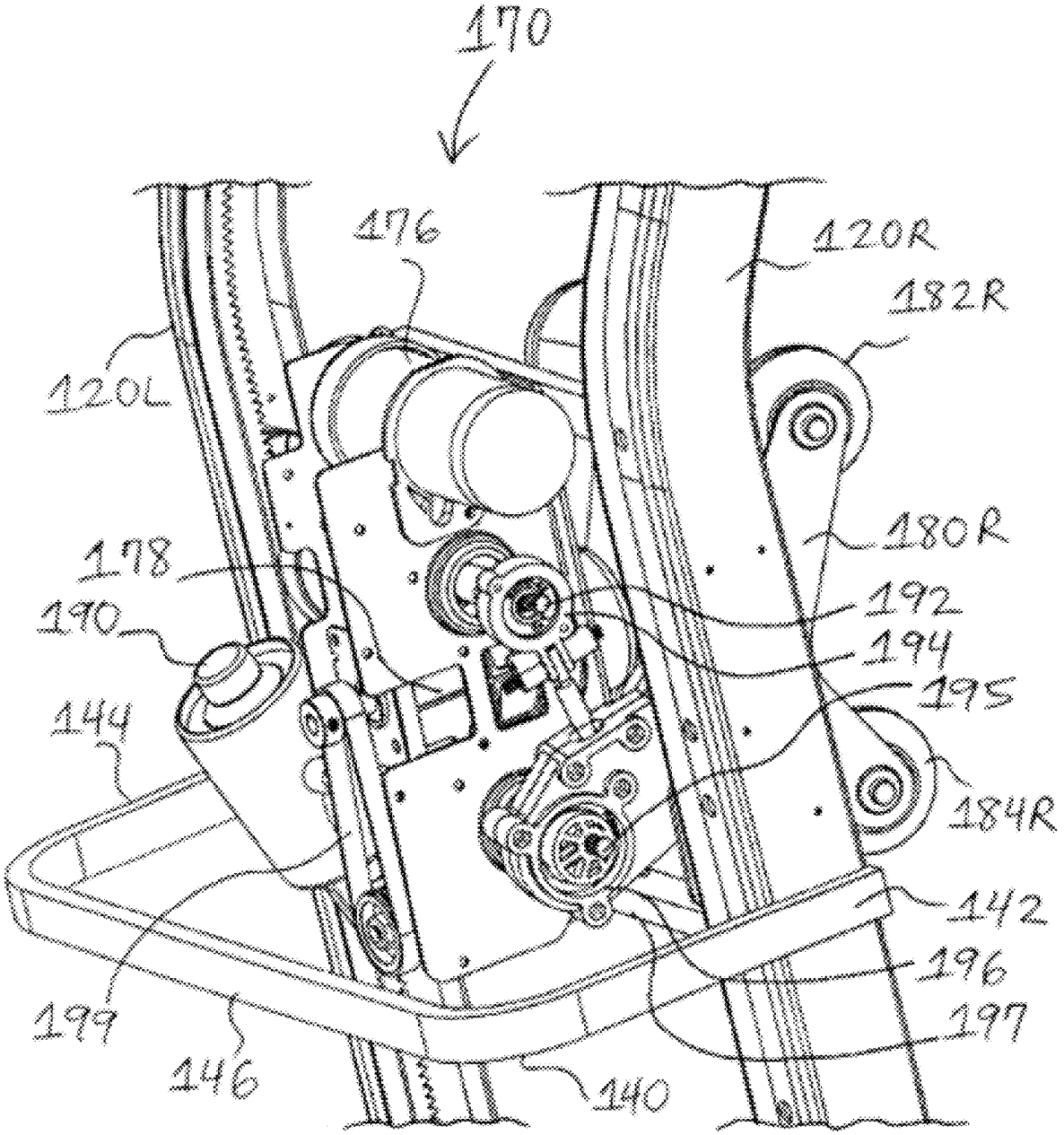
FIG. 7 is a perspective, rear and right side view of a massage device of the massage apparatus for a massage chair of FIG. 1.
Figure 8:
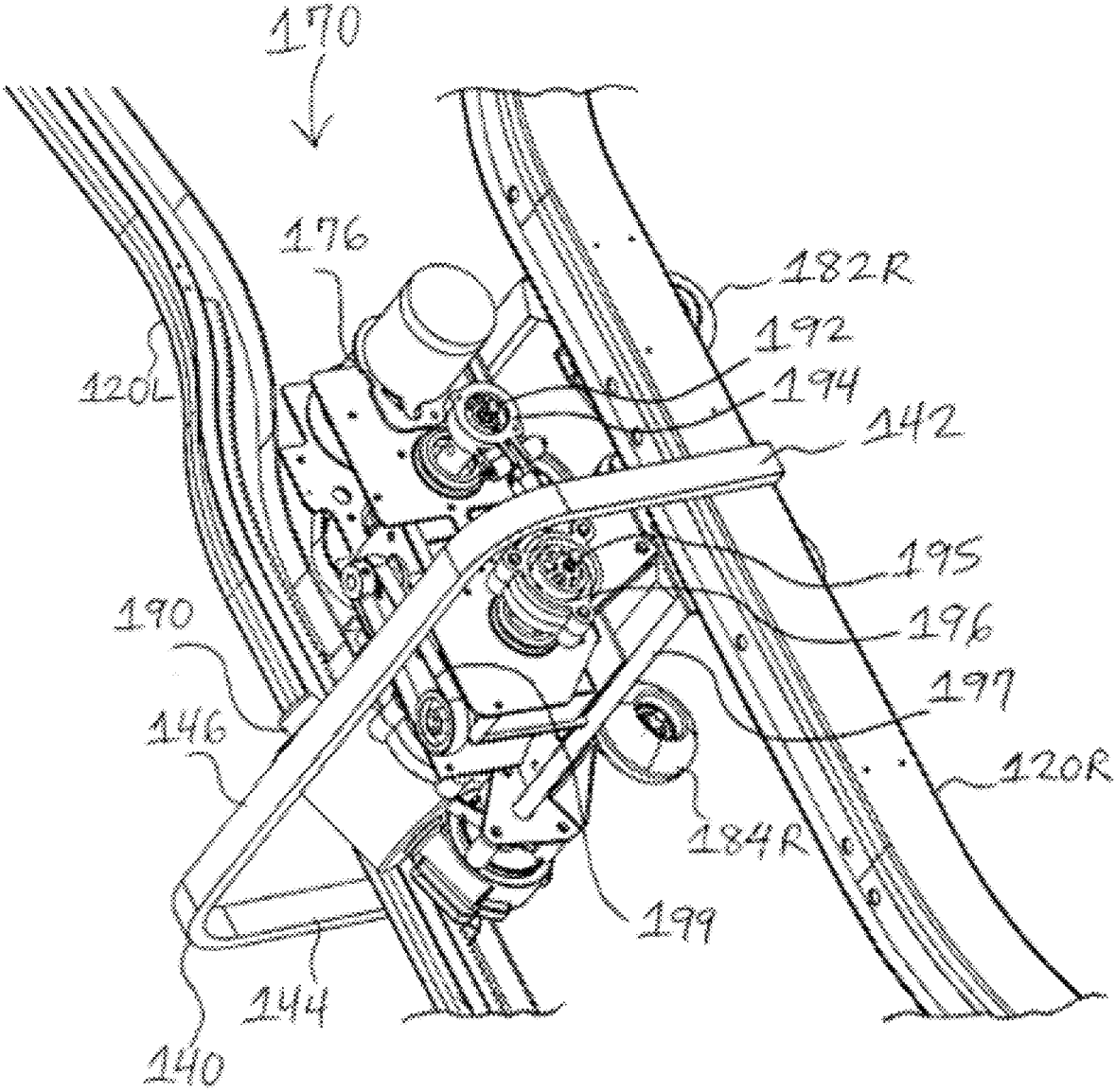
FIG. 8 is another perspective, rear and right side view of a massage device of the massage apparatus for a massage chair of FIG. 1.

As best shown in FIGS. 6-8, the first and second motors 176, 178 provide power to the pair of massage arms 180R, 180L, respectively, while the third motor 190 provides power for the generally vertical movement of the massage device 170.

As best shown in FIGS. 6-8, the rotation shaft 192 driven by the first motor 176 causes the first massage arm 180R to be activated and to carry out its massage actions when this rotation shaft 192 is rotated.

As best shown in FIGS. 6-8, each of the pair of rotation to knocking translator members 194 assists the corresponding massage arm 180R, 180L and corresponding massage roller(s) 182R, 182L, 184R, 184L to carry out its knocking massage actions when the corresponding rotation shaft 192, 195 is rotated.

As best shown in FIGS. 6-8, the rotation shaft 195 driven by the second motor 178 causes the second massage arm 180L to be activated and to carry out its massage actions when this rotation shaft 195 is rotated.

As best shown in FIGS. 6-8, each of the pair of rotation to kneading translator members 196 assists the corresponding massage arm 180R, 180L and corresponding massage roller(s) 182R, 182L, 184R, 184L to carry out its kneading massage actions when the corresponding rotation shaft 192, 195 is rotated.

As best shown in FIGS. 6-8, the rotation shaft 197 for vertical movement gears driving causes the massage device 170 to move upward or downward when this rotation shaft 197 is rotated.

As best shown in FIG. 6, the speed reduction belt 198 for the first motor 176 adjusts the speed of the first massage arm 180R.

As best shown in FIGS. 6-8, the speed reduction belt 199 for the second motor 178 adjusts the speed of the second massage arm 180L.

When in use or in operation, the user (not shown) may activate the massage device 170 of the massage apparatus 100 for a massage chair by or via pushing, touching, using voice command for use on or with, using a mechanical or remote control for use on or with, or any other activation method known to one of ordinary skill in the art, an activation, start, control or command button, touch area, box or panel, or any other activation method or element known to one of ordinary skill in the art. Preferably, the user is able to control the generally vertical movement of the massage device 170 and massage rollers 182R, 182L, 184R, 184L upward and downward along the guide rails 120R, 120L such that the massage device 170 and massage rollers 182R, 182L, 184R, 184L are positioned about, near or at a desired body part area, such as the thighs, bottom, lower back, upper back, and head and neck, of the user so that desired body part area of the user can receive massage effects or benefits from the massage rollers 182R, 182L, 184R, 184L when desired. Preferably, the user is also able to control the timing, movement, etc. of the massage rollers 182R, 182L, 184R, 184L such that that the massage rollers 182R, 182L, 184R, 184L can provide different massage effects or benefits, such as knocking, keading, etc., to the desired body part area of the user at a particular moment or time.

Figure 9:
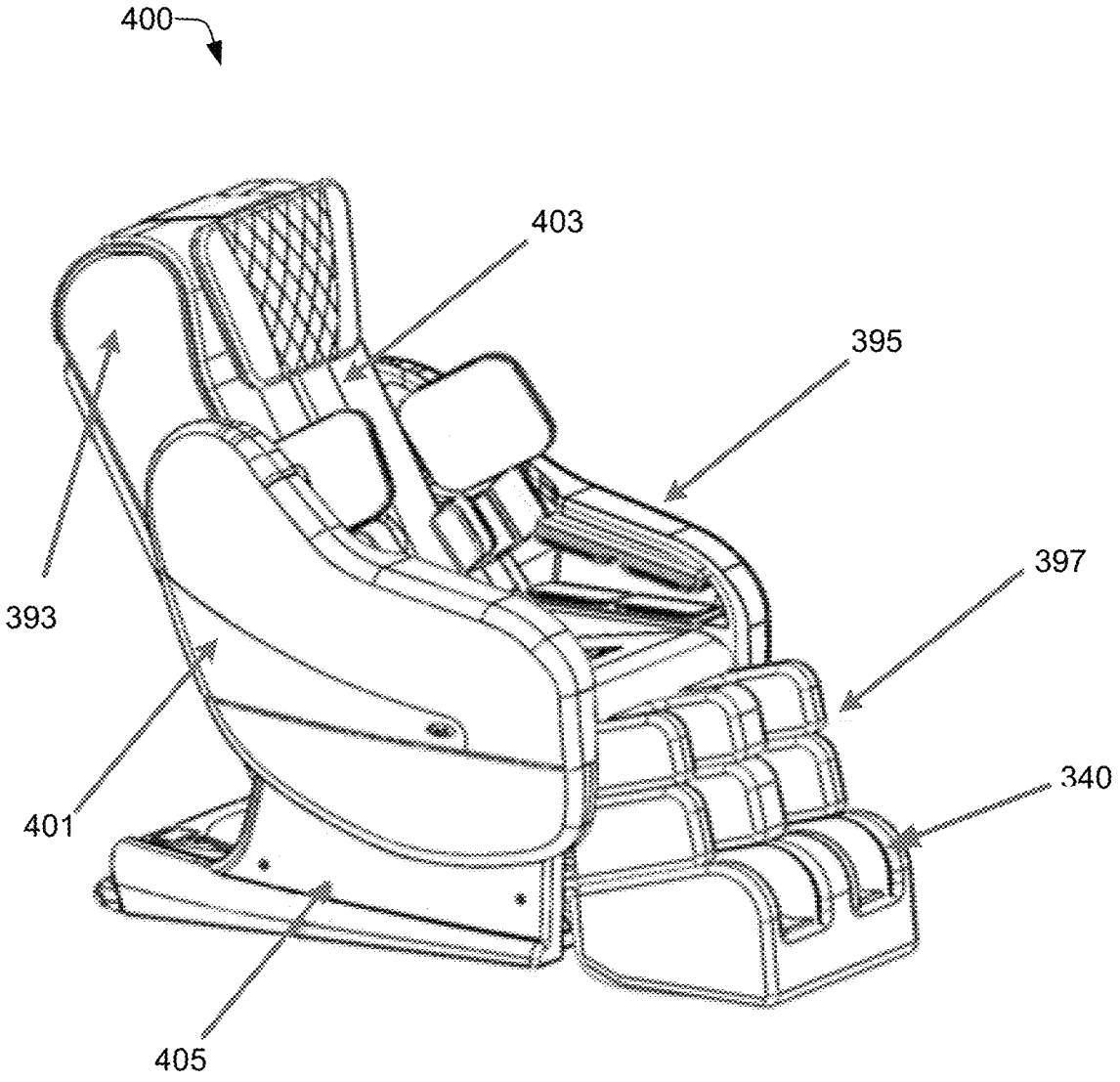
FIG. 9 is a perspective view of a massage chair according to an embodiment of the present application.

Referring now to FIG. 9 in the drawings, an alternate embodiment of a massage chair utilizing a massage apparatus is illustrated. Massage chair 400 is configured to induce a stretching effect upon a user's body as well as a massaging stimulation. Massage chair 400 uses a massage apparatus similar in form and function to that of apparatus 100 discussed previously. Within the available Figures massage chair 400 is shown to include a fixed base frame 403, an extendable footrest frame 409 with a DC actuator, a backrest frame 413, a calf/foot massage airbag system 397, a backrest bidirectional DC actuator 411, a footrest lifting bidirectional DC actuator 407, and an embedded software program to control the motions of the actuators to generate the stretching effect to the body of the user.

In operation, the base frame 405 remains stationary and the footrest frame 409 moves downward. The backrest frame 413 reclines backward and the foot airbags 340 are inflated in a manner so as to grasp the user's feet. The footrest frame 409 then extends via the operation of the actuator. The feet airbags 340 are inflated by allowing air from an air compressor 352 to pass through an air valve 351 controlled by an electronic circuit board and selected software. Once the stretching is completed, the footrest frame 409 moves upward and the backrest frame 413 reclines upward. The foot airbags 340 are deflated and the footrest frame 409 moves upward by the actuator.

Chair 400, as seen, is a chair configured to wrap around portions of a user's body to provide a comfortable resting position. Chair 400 is configured to move in a plurality of manners so as to achieve various positions. Within chair 400 are one or more motors or massagers that work in communication with one another to facilitate massages and stretching of the user. For example, as seen in FIG. 9, chair 400 further includes a back massager 393, an arm massager 395, and a calf/foot massager 397. Airbags 340 are included within portions of the chair 400.

Figure 10:
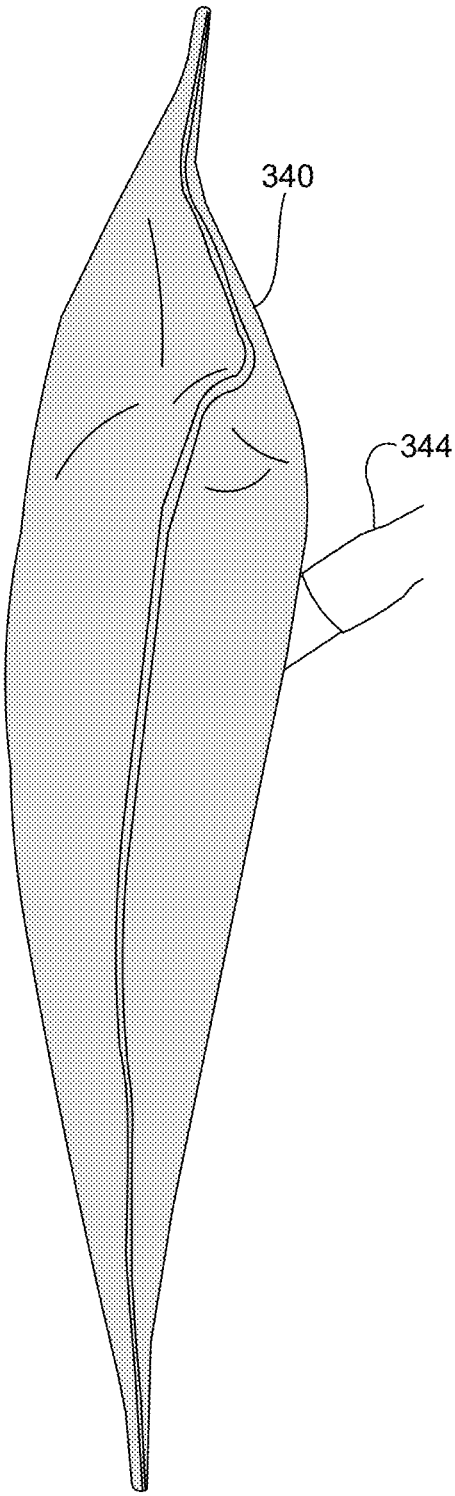
FIGS. 10 and 11 are views of an air-cell used in a massage chair of the present application.
Figure 11:
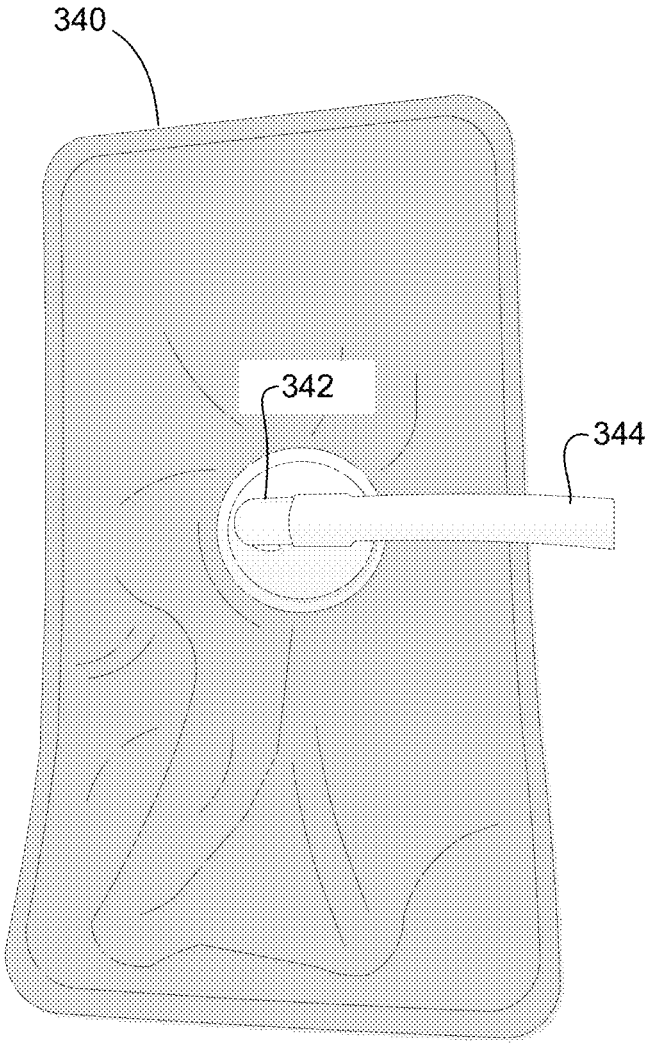
Figure 12:
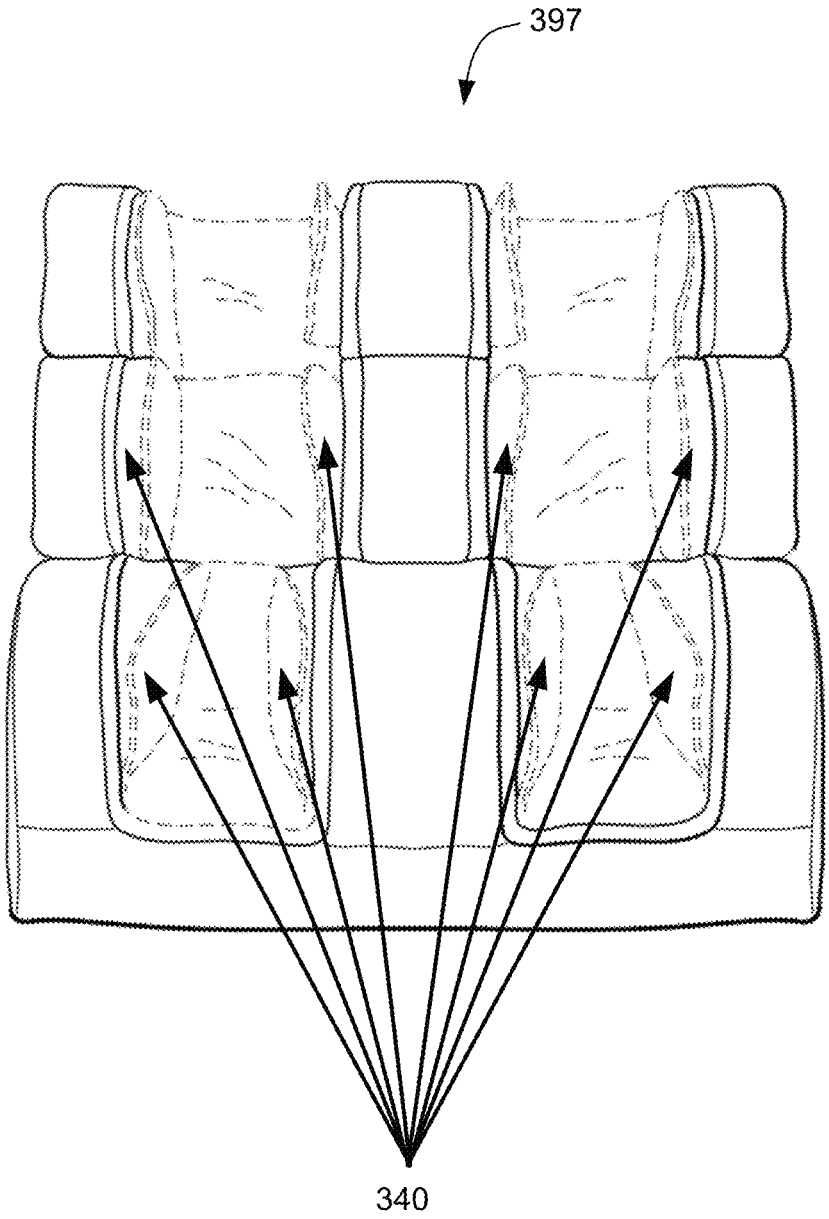
FIG. 12 is a front view of a portion of the massage chair of FIG. 9 with the airbags of FIGS. 10 and 11.

Referring now also to FIGS. 10-12 in the drawings, adjustable airbags used in combination with the massage chair 400 is illustrated. As seen in FIGS. 10-11, airbags 340 (air-cells) are inflatable members configured to hold a selected pressure of air. The air is captured between at least two layers of material. Each airbag 340 is configured to have at least one port 342 to permit the introduction and release of air into the airbag 340. Air is delivered via a line 344 in communication with the port 342. It is understood that the airbags 340 are not limited to a particular material or number of internal chambers. A single chamber may exist or a plurality of internal chambers. The airbags 340 are configured to assist in the performance of massages by the massage chair 400.

As seen in FIG. 12, the airbags 340 are dispersed about the massage chair 400. In particular to FIG. 12, depicted locations for airbags 340 are shown in calf/foot massager 397. Each airbag 340 may be located externally or internally within the massage chair 400. FIG. 12 shows a front view of massager 397. During operation, airbags 340 may inflate in an alternating manner so as to push a user's feet side to side (left and right) thereby creating a swinging motion of the feet over foot rollers in communication with footrest frame 409. It is understood that one or more airbags 340 may be located at each notated position in Figure. It is further understood that airbags 340 may at least be located other locations within chair 400 in combination with massagers 393 and 395 as well. Massage chair 400 may include a detachable armrest 401 and a main body 403. It is understood that the airbags 340 may inflate and deflate simultaneously or in an alternating manner. The act of inflating and deflating may be independently regulated and performed in a sequential manner from other airbags 340 within massage chair 400.

Figure 13:
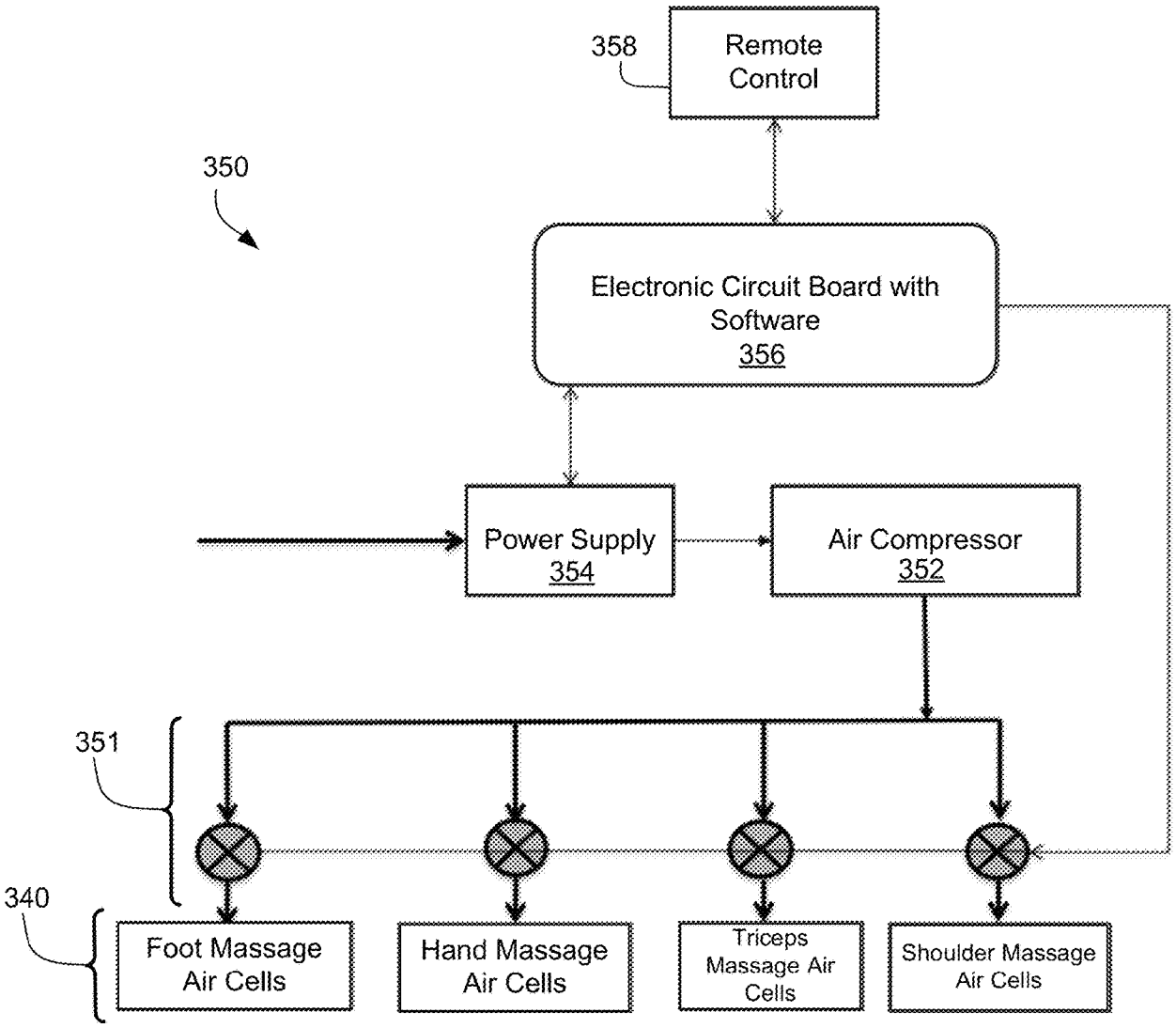
FIG. 13 is a flow chart of an air system used with the massage chair of FIG. 9.

Referring now also to FIG. 13 in the drawings, a flow chart of an air system 350 used in the massage chair 400 is illustrated. System 350 includes valves 351, an air compressor 352, a power supply 354, an electronic circuit board 356, and an optional remote control 358. System 350 regulates the selective filling and draining of air within each airbag 340.

Airbags 340 are configured to be selectively filled and drained of air in an effort to effectuate a massage or treatment to the physical body of the user. Each airbag 340 is coupled in fluid communication to a bank of valves 351, wherein one or more valves are used to regulate the air pressure within the one or more airbags 340. Each valve in the bank of valves 351 is in fluid communication with air compressor 352. Board 356 is configured to regulate operation of valves 351 via electrical current to facilitate the passage of air through valves 351. Board 356 also regulates or controls the motors used with the frames and massagers of chair 400. Power supply 354 provides power. Remote control 358 is configured to provide a user interface to the control of system 350. Remote control 358 may be incorporated into device 300 or be a stand-alone device.

Figure 14:
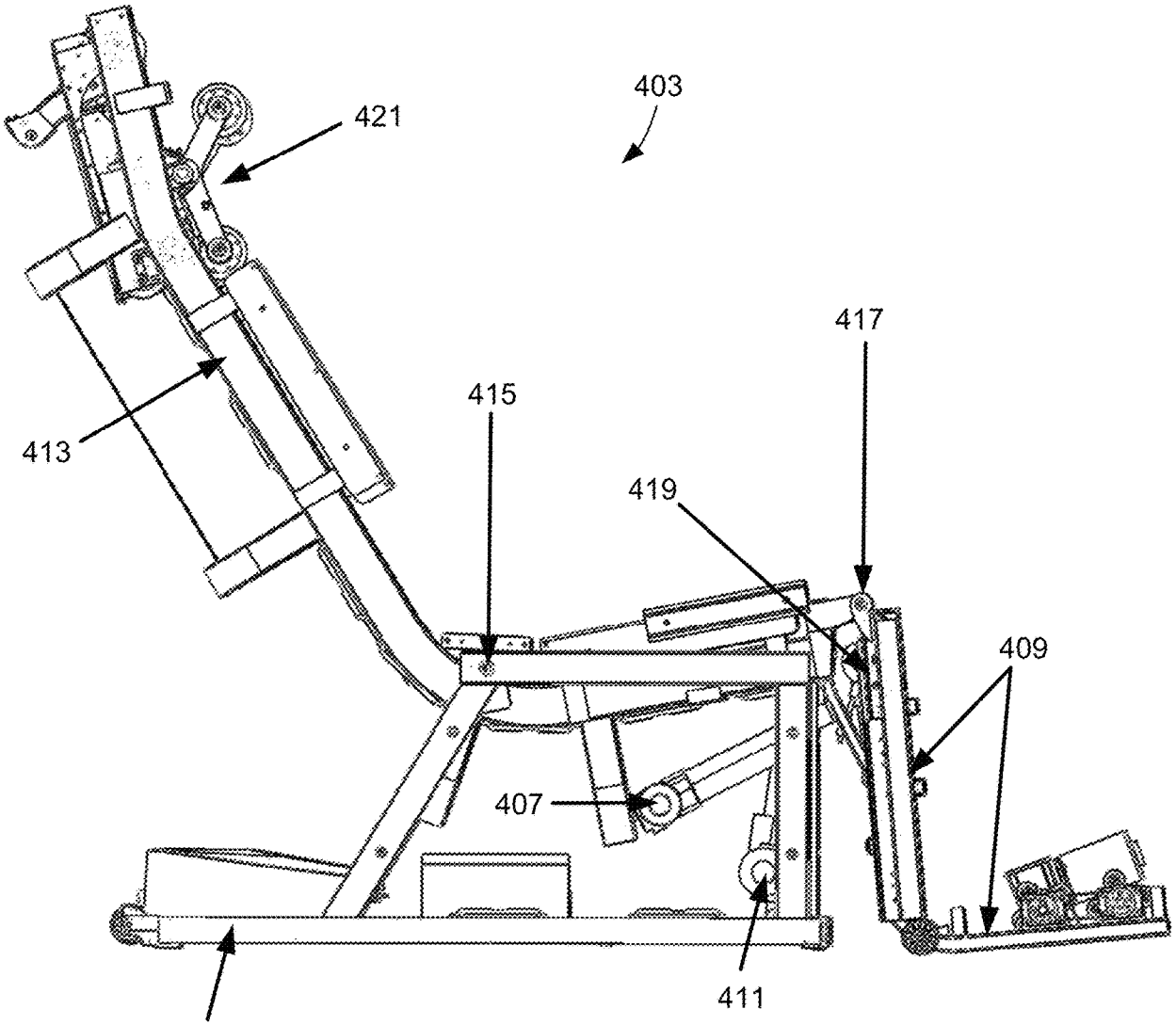
FIG. 14 is a side view of a main body frame of the massage chair of FIG. 9.

Referring now also to FIG. 14 in the drawings, a side view of the frame of main body 403 is illustrated without airbags 340 and external padding so as to show the mechanical structure that lies therein. Main body 403 includes an assortment of actuators and assemblies to facilitate operation of chair 400. Chair 400 includes a base frame 405 that is typically fixed in orientation and position. Base frame 405 contacts the ground and provides upper support for the seat portion of chair 400.

In communication with base frame 405 is a bidirectional actuator 407 for lifting extendable footrest frame 409, and a bidirectional actuator 411 for lifting backrest frame 413. The backrest frame 413 pivots off base frame 405 along an axis 415 wherein the axis extends between arms of chair 400. Footrest frame 409 pivots about an axis 417 of rotation within the area where the seat portion and the footrest frame 409 meet. Further included is a bidirectional actuator 419 configured to extend extendable footrest frame 409. Chair 400 further includes at least one massage device 421 that may be used in conjunction with that of back massager 393. The frame comprises at least a guide rail and a guide channel that provide the track for the massage device 421 to travel along the backrest 413. The footrest and the backrest orientations are adjusted via actuators 407, 411, and 419.

Figure 15:
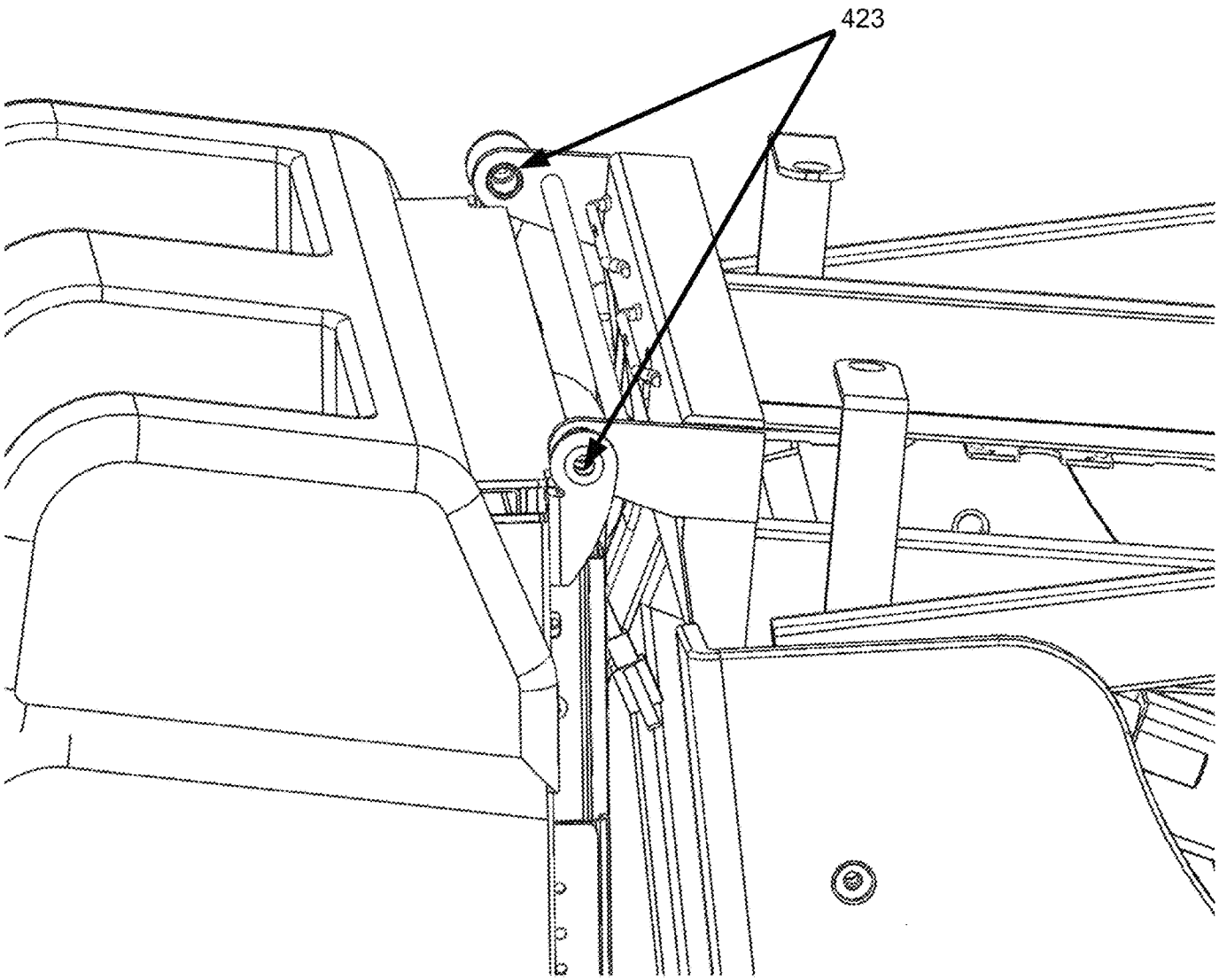
FIG. 15 is an enlarged perspective view of a portion of the main body frame of FIG. 14.

Referring now also to FIG. 15 in the drawings, an enlarged perspective view of main body 403 is illustrated. Mounting points 423 of footrest frame 409 to the main frame are illustrated.

Figure 16:
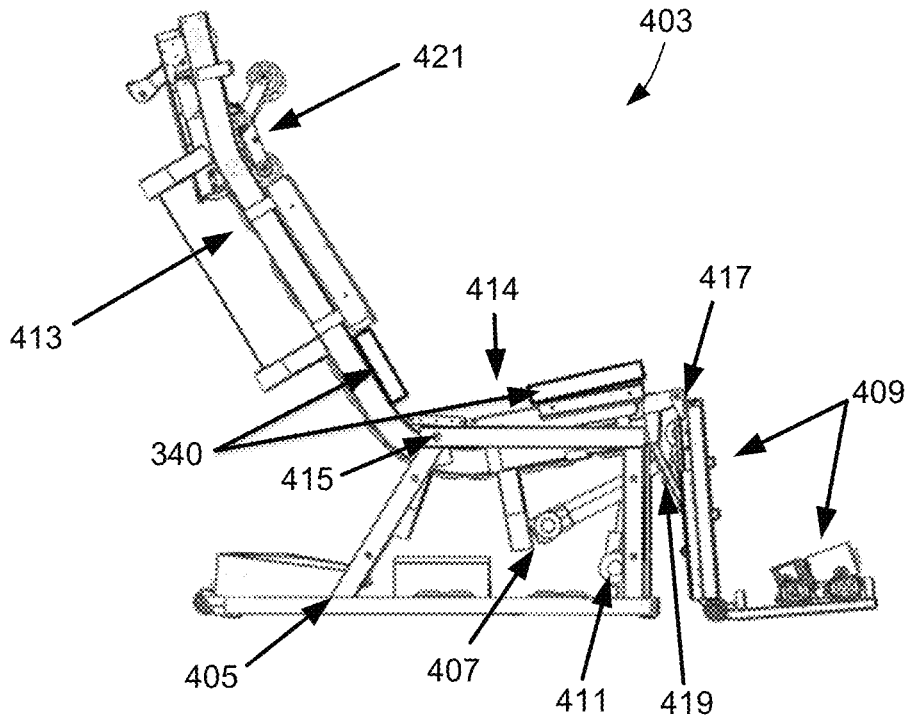
FIG. 16 is an alternate side view of the main body frame of FIG. 14.
Figure 17:
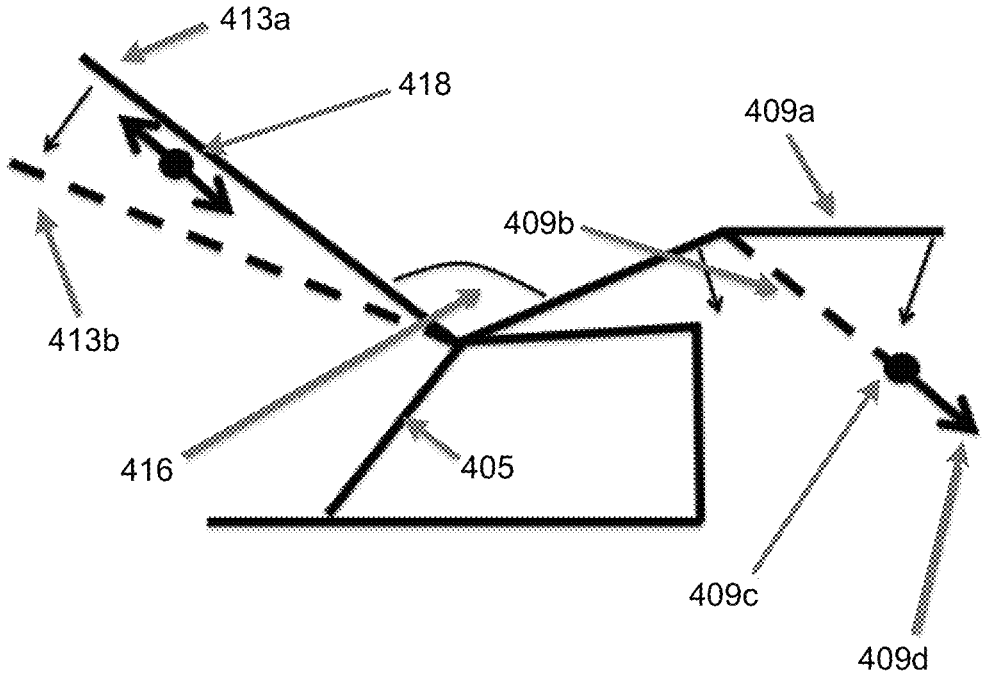
FIG. 17 is a schematic of the operation of the main body frame of FIG. 14.

Referring now also to FIGS. 16 and 17 in the drawings, the operation of massaging a user's back and stretching a user is shown with via a side view of the frame of chair 400. In FIG. 17 a simplified schematic of the operation of the chair 400 is provided. As seen in FIG. 16, chair 400 may include additional airbags 340 located in places other than foot frame 409. For example, an additional airbag is located on seat portion 414 and backrest frame 413 to engage the user's hip and thigh locations and to help in the enhancement of stretching of the user.

Backrest frame 413 operates between at least a first position 413*a* and a second position 413*b* by rotating about axis 415. In operation, not only can frame 403 pivot about axis 415, but the angle 416 between seat portion 414 and backrest frame 413 may be configured to selectively change as backrest frame 413 alternates between positions. In like manner, footrest frame 409 operates between at least a first position 409*a* and a second position 409*b*. The angle of elevation of footrest frame 413 can change relative to seat portion 414. Additionally, footrest frame 409 may be extended in length such that footrest frame 409 can extend at the bottom from a first position 409*c* to a second position 409*d*. In this manner, footrest frame 409 may extend in length and elevate. The act of stretching the user occurs predominantly when footrest frame 409 engages actuator 419 to extend a portion of footrest frame 409 between a retracted first position 409*c* and an extended second position 409*d*. Similarly to that of footrest frame 409, backrest frame 413 may include one or more arms and mechanisms 418 that may travel up and down along the length of frame 409 so as to induce a stretching and massaging effect.

Figure 18:
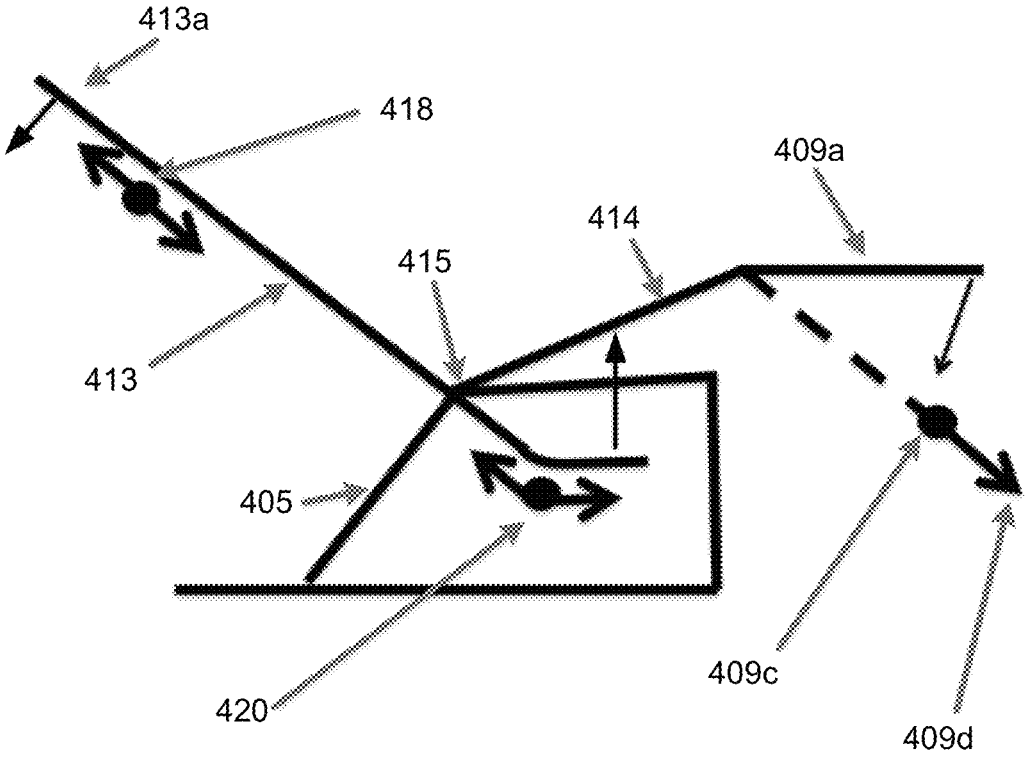
FIG. 18 is an alternate schematic of the operation of the main body frame of FIG. 14.

Referring now also to FIG. 18 in the drawings, the operation of inducing a stretching motion and providing a thigh massage is illustrated via a schematic of the frame of chair 400 as similarly shown in FIG. 17. Chair 400 is also configured to provide a massaging effect upon the thighs of the user at the same time as inducing a stretching motion. The schematic of FIG. 18 is similar to that of FIG. 17. Both backrest frame 413 and footrest frame 409 operate between set positions and footrest frame 409 may also be extended. In FIG. 18, however, chair 400 includes one or more robot arms and massage mechanisms 420 that rotate with the positioning of backrest frame 413.

As seen in FIG. 18, robot arms and massage mechanisms 420 move up toward seat portion 414 for providing a thigh massage when backrest frame 413 reclines. These move simultaneously and in proportion to each other. In other embodiments it is conceived that such may move independently from one another to provide increased control to a user. Furthermore, backrest frame 413 may include any number of guide rails and channels to translate along its frame both above and below seat portion 414 to aid in facilitating the movement of main body 403.

Figure 19:
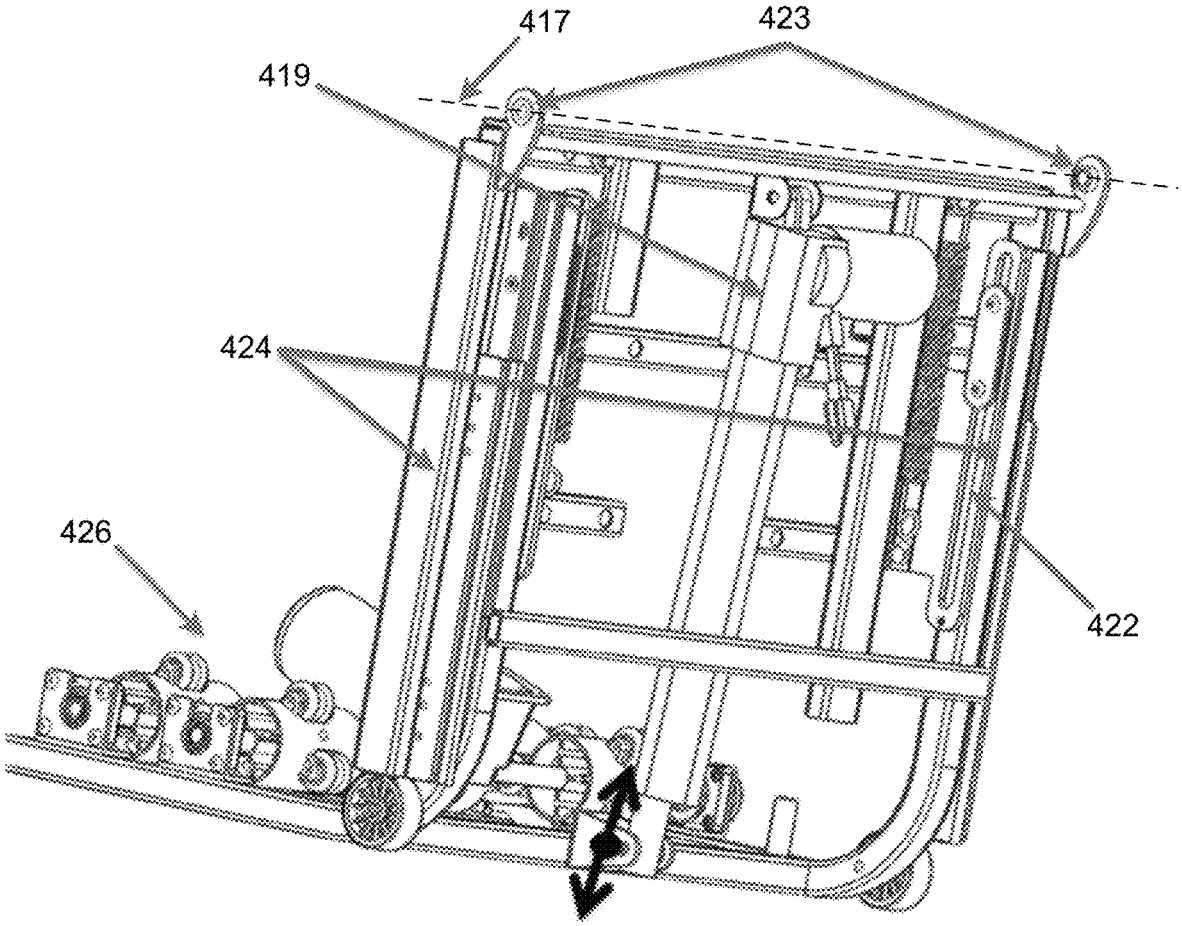
FIG. 19 is an enlarged rear perspective view of a footrest frame in the main body frame of FIG. 14.

Referring now also to FIG. 19 in the drawings, an enlarged rear perspective view of footrest frame 409 is illustrated. This view is helpful in seeing how the extension of footrest frame 409 occurs. Frame 409 includes a linear slider 422 and a pair of parallel linear rails 424 with a sliding mechanism that are configured to permit translating of a portion of footrest frame 409 between positions 409*c* and 409*d*. Actuator 419 is used to extend footrest frame 409 by translating part of frame 409 via rails 424. Slider 422 translates in rails 424. The direction of movement of frame 409 is shown as frame 409 operates between positions 409*c* and 409*d*.

A foot roller mechanism 426 is shown at the base of frame 409 for providing a massage effect upon the user. Additionally, as seen in FIG. 19 is the mounting points 423 and axis of rotation 417 are shown in better clarity.

Figure 20:
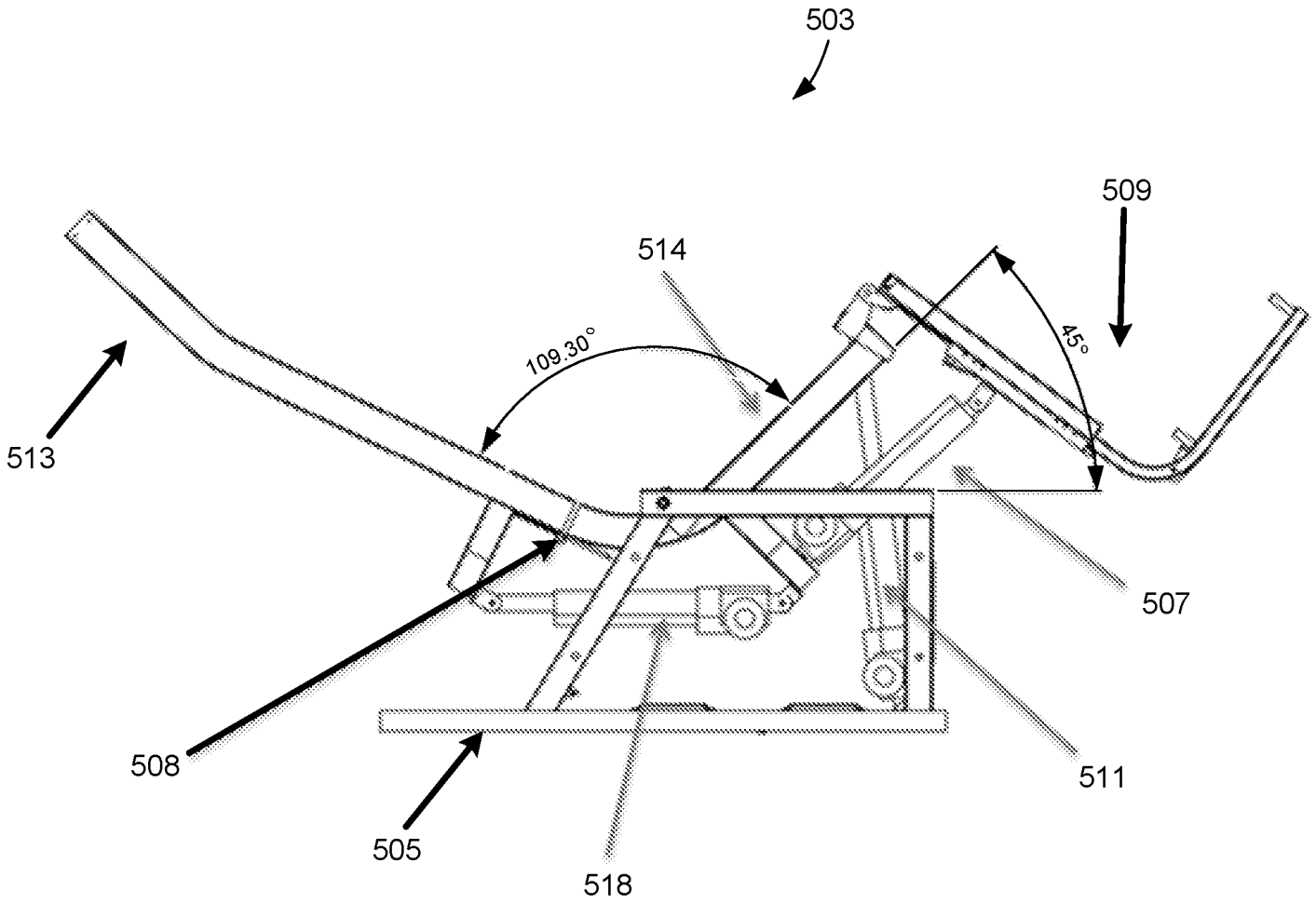
FIGS. 20 and 21 is are side views of an alternate embodiment of the main body frame of FIG. 14.
Figure 21:
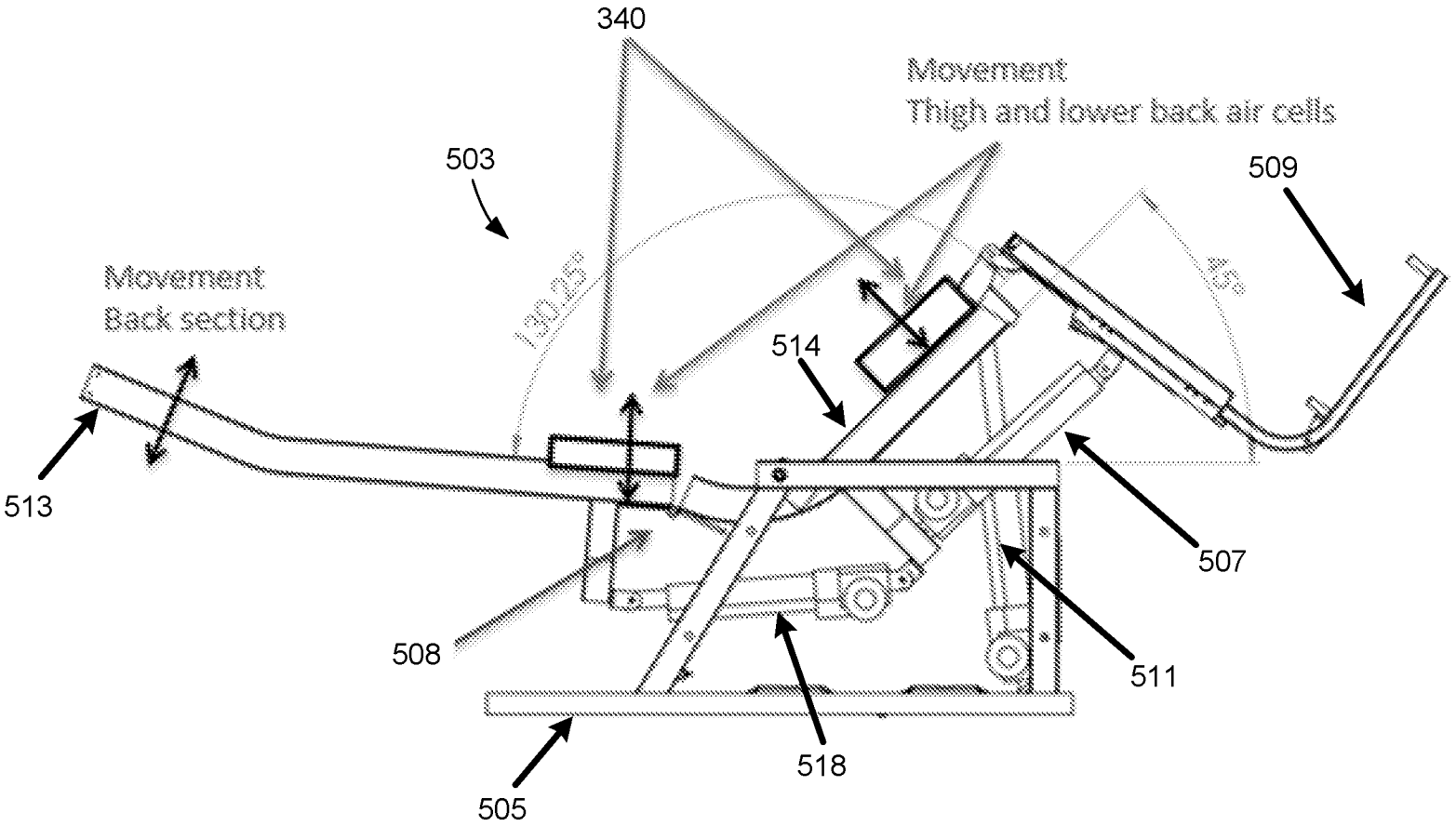

Referring now also to FIGS. 20 and 21 in the drawings, a side view of an alternate embodiment of the main body frame 403 is illustrated. Main body frame 503 is similar in form and function to that of main body frame 403. Chair 400 is operable with both frames 403 and 503. Frame 503 is shown in a simplified manner with various mechanisms and elements removed to assist in clarity. In FIG. 21, airbags 340 are shown for contextual purposes in relation to the portions of frame 503 in operation.

Frame 503 includes a backrest frame 513 and a seat portion 514. A footrest actuator 507 is similar to actuator 407 and is used to elevate footrest frame 509 between positions as described above. Actuator 507 is coupled to a rear portion of frame 509 and a lower extending member of seat portion 514. Frame 509 may elevate and extend as needed. Actuator 511 extends between seat portion 514 and the base frame 505. Actuator 511 is similar in form and function to that of actuator 411. Operation of actuator 511 acts to rotate seat portion 514 about base frame 505.

Of note with frame 503 is the existence of a mechanical rotating joint 508 that separates backrest 513 from seat portion 514. This joint 508 permits for the free rotation and reclining of backrest frame 513 independent from seat portion 514. Backrest frame 513 includes a split track to help facilitate back stretching by allowing the angle between seat portion 514 and frame 513 to increase so as to place frame 513 in a more linearly aligned position with seat portion 514. In other words, frame 513 can recline from seat portion 514. The split location is between the back and the seat portions of the guide rail. During back recline operations, the guide rail and guide channel are partially split.

Main body frame 503 includes a back-reclining actuator 518 configured to induce rotation of frame 513 relative to seat portion 514. As seen in FIG. 21, backrest frame 513 is rotated about joint 508 such that the angle between them has increased. It is understood that the listing of measured degrees are meant to be instructive as opposed to be limiting of the actual function of the embodiment. Actuator 518 extends between the lower extending member of seat portion 514, opposite that of actuator 507, and a lower extending frame member of frame 513. Also seen in FIG. 21 are the use of airbags 340 located adjacent frame 513 and seat portion 514. The combined movement of frame 503 and the operation of airbags 340 helps to provide a stretching motion on the user effective on both the lower and upper appendages and central core of the user's body. The airbags 304 about the lower back area and thighs also enhance the stretching and create a body twisting massage effect as the airbags 340 and operated in a selected manner.

Figure 22:
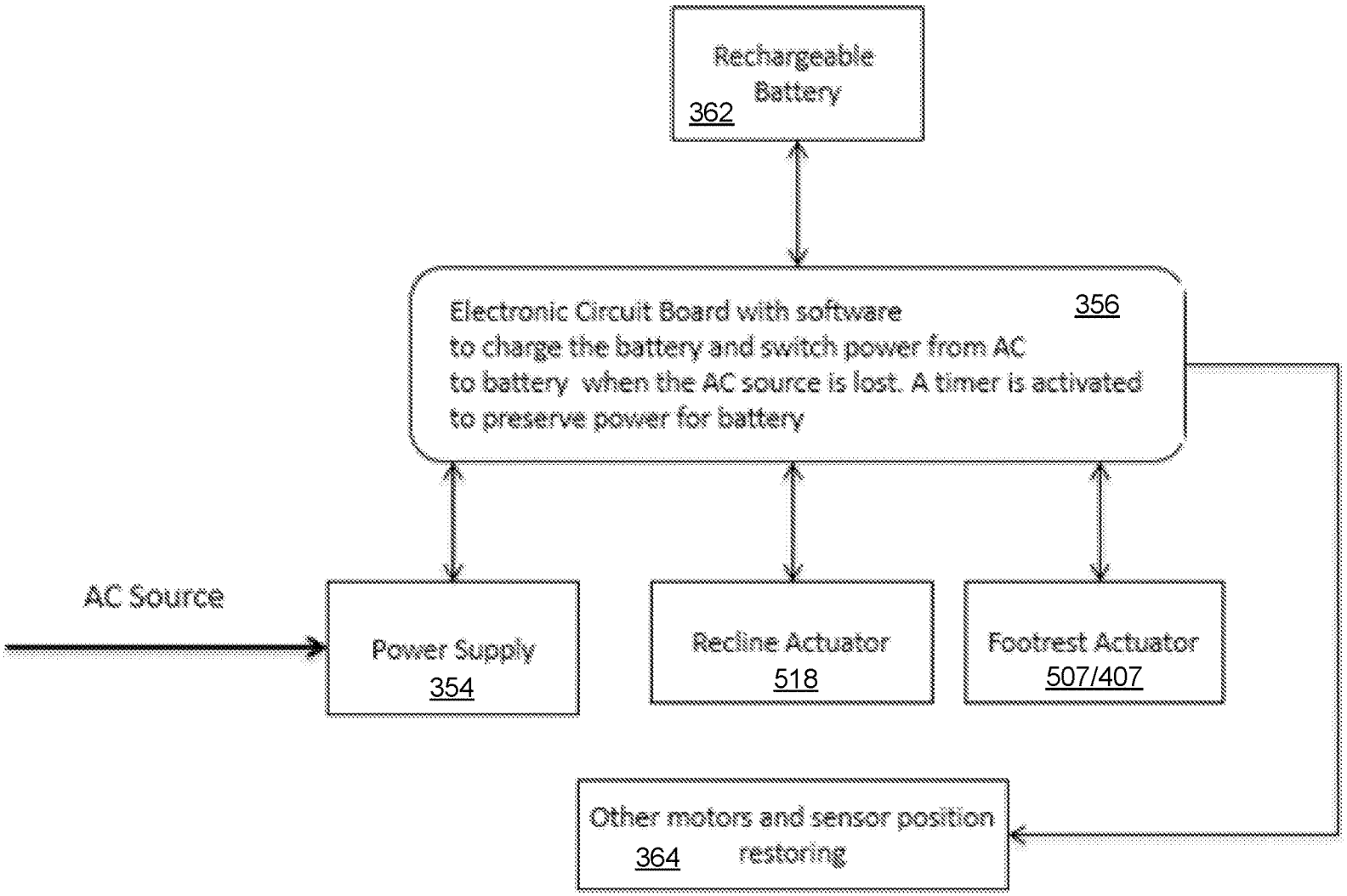
FIG. 22 is a chart of the electrical communication of components in the massage chair of FIG. 9.

Referring now also to FIG. 22 in the drawings, a chart for the massage chair of FIG. 9 is illustrated. Chair 400 is operable with both an AC power source provided through the power grid and a rechargeable battery 362. Power supply 354 provides power to board 356, recline actuator 518, footrest actuator 507/407 and other motors and sensor position restoring components 364. Such components 364 may include any and all of the massagers previously disclosed and other actuators, roller, and motors used with chair 400. Battery 362 is configured to receive charging from the AC power source and selectively supplement power to chair 400. An example of a situation where this may occur is during a power outage. This is advantageous as current massage chairs are not equipped with a backup power source. Users with medical conditions and those that are advanced in age find it extremely difficult to exit conventional massage chairs if power is lost and the chair is not in the upright position, the upright position being when the frame 413/513 is in position 413*a* and frame 409 is in position 409*a* and 409*c*. Battery 362 is a built-in rechargeable battery that automatically activates upon a power loss to permit chair 400 to restore the upright position. Once the upright position is restored, the chair 400 may be placed in a lower power mode to conserve energy.

It is understood that chair 400 may be used in various different ways apart from those illustrated and disclosed herein while being within the scope and intent of the embodiments. Use may include a massage chair to provide massage effects to at least a user's body, feet, legs, and back areas. The massage chair uses a software algorithm with board 356 to control the procedures and operations of the chair 400. These may include inflating the airbags 400 to hold and squeeze the user's feet. Moving the footrest frame elevation and extension with the airbags inflated or deflated. Reclining the backrest frame to a different angle though the recline actuator 518.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A massage chair, comprising:

a base frame;

a backrest frame operable between a first position and a second position, the backrest frame comprises a curved section located near a seat and a backrest section, the backrest frame including a mechanical rotating joint and a guide rail, wherein during operation a stretching effect is configured to be induced by varying an angle between the backrest frame and a seat portion;

a pair of spaced apart racks or guide channels mounted along the backrest frame and following the shape of the backrest frame to provide a continuous movement of a massage device to travel through the curved section;

an extendable footrest frame configured to couple relative to the backrest frame;

a foot massage airbag system including a plurality of airbags structurally supported by the extendable footrest frame; and an electronic circuit board having an embedded software program for regulating the position of the backrest frame and the footrest frame, the electronic circuit board communicating with a compressor and a valve to regulate operation of the plurality of airbags.

2. The massage chair of claim 1, further comprising:

a built-in rechargeable battery pack to provide backup power to the electronic circuit board to permit a return to an upright position of the massage chair.

3. The massage chair of claim 2, wherein the electronic circuit board is configured to switch to a low power mode after reaching the upright position when the rechargeable battery pack is operating.

4. The massage chair of claim 1, wherein the plurality of airbags are configured to push the user's feet left and right creating a swing motion over foot rollers, and wherein operation of the airbags and actuators is configured to induce the stretching effect upon a user as the airbags are filled with air to compress against the user and the extendable footrest frame moves from a retracted first position and an extended second position.

5. The massage chair of claim 1, wherein the stretching effect is configured to be minimized when the plurality of airbags are released of air and the footrest frame moves from the second extended position to the first retracted position.

6. The massage chair of claim 5, wherein the backrest frame is configured to recline upward when the stretching effect is minimized.

7. The massage chair of claim 1, wherein the footrest frame includes a footrest actuator configured to change the elevation of the footrest frame so as to pivot the footrest frame relative to the backrest frame.

8. The massage chair of claim 1, wherein the footrest frame includes a bidirectional actuator to extend a portion of the footrest frame between a retracted first position and a extended second position.

9. The massage chair of claim 1, wherein the backrest frame includes the seat portion.

10. The massage chair of claim 1, wherein the stretching effect is configured to open at least an air valve to inflate at least a first airbag and then activate at least a first actuator to move the footrest frame or the backrest frame from the first position to the second position.

11. A massage chair, comprising:

a base frame;

a backrest frame pivotally coupled to the base frame, the backrest frame operable between a first position and a second position, the backrest frame comprises a curved section located near a seat and a back section extended up from the curved section, the backrest frame including a mechanical rotating joint and a guide rail, wherein the guide rail splits at the rotating joint when transitioning between the first position and the second position;

a pair of spaced apart racks or guide rails mounted along the backrest frame and following the shape of the backrest frame to provide a continuous movement of a massage device to travel through the curved section from the backrest section to the seat;

an extendable footrest frame configured to pivot relative to the backrest frame between a first position and a second position;

a foot massage airbag system including a plurality of airbags coupled to the extendable footrest frame; and an electronic circuit board having an embedded software program for regulating the position of the backrest frame and the footrest frame, the electronic circuit board is configured to communicate with a compressor and a valve to regulate operation of the plurality of airbags;

wherein operation of the airbags is configured to induce a stretching effect upon a user as the airbags are filled with air to compress against the user and the extendable footrest frame moves from a retracted first position and an extended second position.

12. The massage chair of claim 11, further comprising:

a built-in rechargeable battery pack to provide backup power to the electronic circuit board to permit a return to an upright position of the massage chair.

13. The massage chair of claim 12, wherein the electronic circuit board is configured to switch to a low power mode after reaching the upright position when the rechargeable battery pack is operating.

14. The massage chair of claim 11, wherein the plurality of airbags are configured to push the user's feet left and right creating a swing motion over foot rollers.

15. The massage chair of claim 11, wherein the stretching effect is configured to be minimized when the plurality of airbags are released of air and the footrest frame moves from the second extended position to the first retracted position.

16. The massage chair of claim 11, wherein the stretching effect is configured to open at least an air valve to inflate at least a first airbag and then activate at least a first actuator to move the footrest frame or the backrest frame from the first position to the second position.

17. The massage chair of claim 11, wherein the footrest frame includes a footrest actuator configured to change the elevation of the footrest frame so as to pivot the footrest frame relative to the backrest frame.

18. The massage chair of claim 11, wherein the footrest frame includes a bidirectional actuator to extend a portion of the footrest frame between the retracted first position and the extended second position.

19. The massage chair of claim 11, wherein the backrest frame includes a back-reclining actuator configured to pivot the backrest frame relative to the seat portion.

20. The massage chair of claim 11, further comprising:

a second plurality of airbags are located on at least one of the seat portion and the backrest frame.

21. The massage chair of claim 20, wherein the stretching effect is extended to the lower back and thighs of the user.

22. A method for stretching the body, comprising:

obtaining a message chair having:

a base frame;

a backrest frame pivotally coupled to the base frame, the backrest frame operable between a first position and a second position, the backrest frame comprises a curved section located near a seat and a back section extended up from the curved section, the backrest frame including a mechanical rotating joint and a guide rail, wherein the guide rail splits at the rotating joint when transitioning between the first position and the second position;

a pair of spaced apart racks or guide channels mounted along the backrest frame and following the shape of the backrest frame to provide a continuous movement of a massage device to travel through the curved section from the backrest section to the seat;

an extendable footrest frame configured to pivot relative to the backrest frame between a first position and a second position;

a foot massage airbag system including a plurality of airbags coupled to the extendable footrest frame; and an electronic circuit board having an embedded software program for regulating the position of the backrest frame and the footrest frame, the electronic circuit board communicating with a compressor and a valve to regulate operation of the plurality of airbags;

inflating the plurality of airbags;

selectively moving the extendable footrest frame from a retracted first position to an extended second position with the plurality of airbags inflated; and reclining the backrest frame.

23. The method of claim 22, further comprising:

a second plurality of airbags are located on the backrest and a seat portion.

24. The method of claim 23, wherein at least one of the plurality of air bags and the second plurality of airbags inflate simultaneously.

25. The method of claim 22, wherein the plurality of airbags inflate in an alternating manner.

26. The method of claim 22, wherein the massage chair is configured to provide a sequence to initiate a stretching effect is first to open at least an air valve to inflate at least a first airbag and then activate at least a first actuator to move the footrest frame or the backrest frame from the first position to the second position.

27. The method of claim 22, further comprising:

supplementing power through a built-in rechargeable battery pack to provide backup power to the electronic circuit board to permit a return to an upright position of the massage chair.

28. The method of claim 27, wherein the electronic circuit board switches to a low power mode after reaching the upright position when the rechargeable battery pack is operating.

* * * * *